US010126691B2

(12) United States Patent
Tanto

(10) Patent No.: US 10,126,691 B2
(45) Date of Patent: Nov. 13, 2018

(54) IMAGE FORMING DEVICE

(71) Applicant: CANON KABUSHIKI KAISHA, Tokyo (JP)

(72) Inventor: Tomoaki Tanto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/839,692

(22) Filed: Dec. 12, 2017

(65) Prior Publication Data

US 2018/0173139 A1 Jun. 21, 2018

(30) Foreign Application Priority Data

Dec. 16, 2016 (JP) ..... 2016-244799

(51) Int. Cl.
*G03G 15/20* (2006.01)
*G03G 15/00* (2006.01)

(52) U.S. Cl.
CPC ..... *G03G 15/2039* (2013.01); *G03G 15/205* (2013.01); *G03G 15/55* (2013.01); *G03G 2215/2032* (2013.01)

(58) Field of Classification Search
USPC ..... 399/107, 110, 122, 165, 320, 328, 329
See application file for complete search history.

(56) References Cited

U.S. PATENT DOCUMENTS 9,342,013 B2 * 5/2016 Okajima ..... G03G 15/2085

FOREIGN PATENT DOCUMENTS

JP 2014-164116 A 9/2014

* cited by examiner

*Primary Examiner* — Hoan Tran
(74) *Attorney, Agent, or Firm* — Canon U.S.A., Inc. IP Division

(57) ABSTRACT

A pressing mechanism is provided, which is configured to cause the relative position of an endless belt including a layer containing metal to a rotary member to be at a first position or a second position at which a nip portion N is formed. When an error is informed in response to detection of a crack of an end portion of the endless belt by a detecting portion and jam causing a recording medium to remain at the nip portion N occurs, if a power source switch is switched to an OFF state, a power supply to an image forming device is stopped with the relative position being at the second position.

20 Claims, 10 Drawing Sheets

IMAGE FORMING DEVICE

BACKGROUND OF THE INVENTION

Field of the Invention

The present disclosure relates to an electrophotographic image forming device.

Description of the Related Art

A film fixing system configured to fix an unfixed toner image on a recording medium through a film has been known as a fixing device configured to fix an unfixed toner image by heat and pressure.

In the film fixing system, the film moves, in response to rotation thereof, toward an end portion in a longitudinal direction, and the end portion of the film is rubbed against a member such as a flange. When the end portion of the film is continuously rubbed for a long time, there is a probability that the film is cracked or ripped.

Japanese Patent Laid-Open No. 2014-164116 proposes the method for detecting such damage (error) of the film. In the case of normality, the substantially same temperature is maintained between both end portions of the film in the longitudinal direction. However, when one end of the film is damaged, there is a temperature difference between both end portions of the film. Japanese Patent Laid-Open No. 2014-164116 discloses a configuration in which a temperature sensor is provided at each end portion of the film. When a temperature difference of equal to or greater than a predetermined value is caused between the temperature sensors at both end portions, it is determined as the film being damaged, and a device is safely stopped.

Typically, the safety of the device has been sufficiently ensured in such a manner that the device is stopped in response to detection of the damage of the film as in Japanese Patent Laid-Open No. 2014-164116, for example.

SUMMARY OF THE INVENTION

The present disclosure is intended to further enhance safety of a device after stop of the device in response to detection of a crack of an endless belt.

An image forming device includes an image forming portion configured to form an image on a recording medium, an endless belt including a layer containing metal, the endless belt being configured to heat, at a nip portion, the image formed on the recording medium by the image forming portion, a nip formation member provided on the inside of the endless belt, a rotary member cooperating with the endless belt to form the nip portion and configured to rotate the endless belt, a pressing mechanism configured to press the nip formation member and the rotary member to form the nip portion, the pressing mechanism causing a relative position of the nip formation member to the rotary member to be at a first position at which a predetermined recording medium remaining between the endless belt and the rotary member is pullable with a tensile force of 9.8 N or a second position at which the predetermined recording medium remaining between the endless belt and the rotary member is not pullable with the tensile force of 9.8 N, a detecting portion configured to detect a crack of an end portion of the endless belt, a rotation control portion configured to stop rotation of the rotary member according to detection of the crack of the end portion of the endless belt by the detecting portion; an informing portion configured to inform an error in response to detection of the crack of the end portion of the endless belt by the detecting portion, a power source switch switchable between an OFF state for stopping a power supply to the image forming device and an ON state for supplying power to the image forming device, and a pressing control portion configured to control the pressing mechanism. When jam causing the recording medium to remain at the nip portion occurs without detection of the crack of the end portion of the endless belt by the detecting portion, the pressing control portion controls the pressing mechanism such that the relative position is at the first position. When the error is informed by the informing portion and the jam causing the recording medium to remain at the nip portion occurs and the power source switch is switched to the OFF state, the pressing control portion controls the pressing mechanism such that the power supply to the image forming device is stopped with the relative position being at the second position.

An image forming device includes an image forming portion configured to form an image on a recording medium; an endless belt including a layer containing metal, the endless belt being configured to heat, at a nip portion, the image formed on the recording medium by the image forming portion; a nip formation member provided on the inside of the endless belt, a rotary member cooperating with the endless belt to form the nip portion and configured to rotate the endless belt, a pressing mechanism configured to press the nip formation member and the rotary member to form the nip portion, the pressing mechanism causing a relative position of the nip formation member to the rotary member to be at a first position at which a predetermined recording medium remaining between the endless belt and the rotary member is pullable with a tensile force of 9.8 N, a second position at which the predetermined recording medium remaining between the endless belt and the rotary member is not pullable with the tensile force of 9.8 N, or a third position at which the image formed on the recording medium by the image forming portion is heated; a detecting portion configured to detect a crack of an end portion of the endless belt, a rotation control portion configured to stop rotation of the rotary member according to detection of the crack of the end portion of the endless belt by the detecting portion, an informing portion configured to inform an error in response to detection of the crack of the end portion of the endless belt by the detecting portion; a power source switch switchable between an OFF state for stopping a power supply to the image forming device and an ON state for supplying power to the image forming device, and a pressing control portion configured to control the pressing mechanism. When jam causing the recording medium to remain at the nip portion occurs without detection of the crack of the end portion of the endless belt by the detecting portion, the pressing control portion controls the pressing mechanism such that the relative position is at the first position. When the error is informed by the informing portion and the jam causing the recording medium to remain at the nip portion occurs, if the power source switch is switched to the OFF state, the pressing control portion controls the pressing mechanism such that the power supply to the image forming device is stopped with the relative position being at the second position.

An image forming device includes an image forming portion configured to form an image on a recording medium; an endless belt including a layer containing metal, the endless belt being configured to heat, at a nip portion, the image formed on the recording medium by the image forming portion, a nip formation member provided on the inside of the endless belt, a rotary member cooperating with the endless belt to form the nip portion and configured to rotate the endless belt, a pressing mechanism configured to press the nip formation member and the rotary member to form the nip portion, the pressing mechanism causing a relative position of the nip formation member to the rotary member to be at a first position or a second position different from the first position and the nip portion being formed at the second position, a detecting portion configured to detect a crack of an end portion of the endless belt, a rotation control portion configured to stop rotation of the rotary member according to detection of the crack of the end portion of the endless belt by the detecting portion, an informing portion configured to inform an error in response to detection of the crack of the end portion of the endless belt by the detecting portion, a power source switch switchable between an OFF state for stopping a power supply to the image forming device and an ON state for supplying power to the image forming device, and a pressing control portion configured to control the pressing mechanism. When jam causing the recording medium to remain at the nip portion occurs without detection of the crack of the end portion of the endless belt by the detecting portion, the pressing control portion controls the pressing mechanism such that the relative position is at the first position. When the error is informed by the informing portion and the jam causing the recording medium to remain at the nip portion occurs, if the power source switch is switched to the OFF state, the pressing control portion controls the pressing mechanism such that the power supply to the image forming device is stopped with the relative position being at the second position.

An image forming device includes an image forming portion configured to form an image on a recording medium; an endless belt including a layer containing metal, the endless belt being configured to heat, at a nip portion, the image formed on the recording medium by the image forming portion, a nip formation member provided on the inside of the endless belt, a rotary member cooperating with the endless belt to form the nip portion and configured to rotate the endless belt, a pressing mechanism configured to press the nip formation member and the rotary member to form the nip portion, the pressing mechanism causing a relative position of the nip formation member to the rotary member to be at a first position, a second position which is different from the first position and at which the nip portion is formed, or a third position which is different from the first position and the second position and at which the image formed on the recording medium by the image forming portion is heated, a detecting portion configured to detect a crack of an end portion of the endless belt, a rotation control portion configured to stop rotation of the rotary member according to detection of the crack of the end portion of the endless belt by the detecting portion, an informing portion configured to inform an error in response to detection of the crack of the end portion of the endless belt by the detecting portion, a power source switch switchable between an OFF state for stopping a power supply to the image forming device and an ON state for supplying power to the image forming device, and a pressing control portion configured to control the pressing mechanism. When jam causing the recording medium to remain at the nip portion occurs without detection of the crack of the end portion of the endless belt by the detecting portion, the pressing control portion controls the pressing mechanism such that the relative position is at the first position. When the error is informed by the informing portion and the jam causing the recording medium to remain at the nip portion occurs, and the power source switch is switched to the OFF state, the pressing control portion controls the pressing mechanism such that the power supply to the image forming device is stopped with the relative position being at the second position.

Further features of the present disclosure will become apparent from the following description of exemplary embodiments (with reference to the attached drawings).

DESCRIPTION OF THE EMBODIMENTS

Preferred embodiments of the present disclosure will be described below in detail with reference to the attached drawings. Note that components described in these embodiments will be set forth merely as examples, and the present disclosure is not limited to those described in the embodiments.

First Embodiment

Figure 2:
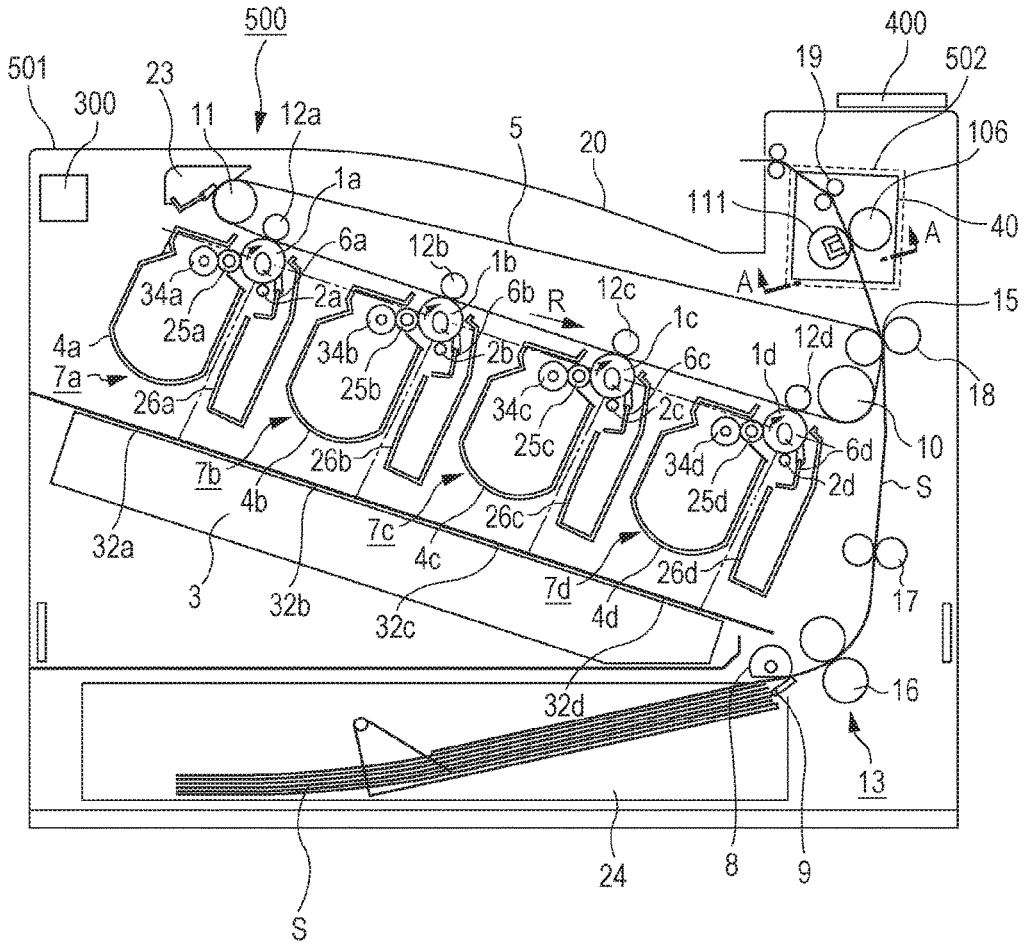
FIG. 2 is a view of an example of an image formation device.

FIG. 2 is a view of an example of an image formation device. FIG. 2 illustrates a state of a section of an electrophotographic color printer as an example of the image formation device (an image forming device) from a front side.

In the present embodiment, a full-color intermediate transfer device will be described as an example of an image formation device (an image forming device) 500, but the present disclosure is not limited to such a device. For example, a direct transfer device for direct transferring from a photoconductive drum 1 (1*a* to 1*d*) onto a recording medium S without a later-described intermediate transfer belt 5 or a device (e.g., a black-and-white machine) configured to form a toner image in a single color may be employed. Alternatively, the image formation device 500 may be a copying machine, a printer, a facsimile device, or a multifunction machine having these multiple functions.

The recording medium S is a medium on which a toner image (an image) is formed by the image formation device 500. Specific examples of the recording medium S may include regular paper, thick paper, and an overhead projector sheet. Note that for the sake of convenience, handling of the recording medium (a sheet) S will be described by means of terms relating to paper, such as sheet passing, sheet supply, sheet discharge, a sheet passing portion, and a non-sheet-passing portion, but the recording medium is not limited to paper.

Four image formation portions 7 (7*a* to 7*d*) are arranged diagonally in an upper-to-lower direction in a housing 501 of the image formation device 500. The image formation portion (an image forming portion) 7 (7*a* to 7*d*) includes the photoconductive drum 1 (1*a* to 1*d*) as an electrophotographic photosensitive member, and a development unit 4 (4*a* to 4*d*) as a development portion. The four image formation portions 7 (7*a* to 7*d*) correspond respectively to colors of Y (yellow), M (magenta), C (cyan), and Bk (black).

For preventing complicated description, the four image formation portions will be collectively indicated by a reference numeral "7" below, and the following relating process techniques are similar among the four image formation portions 7. The order of arrangement of the image formation portions 7 for the colors Y, M, C, Bk is not limited to above.

The photoconductive drum 1 is driven to rotate clockwise as viewed in FIG. 2 by a drive member (not shown). Moreover, a cleansing member 6 (6*a* to 6*d*), a charging roller 2 (2*a* to 2*d*) as a charging portion, and the development unit 4 are, at the periphery of the photoconductive drum 1, arranged in this order in a rotation direction of the photoconductive drum 1.

The cleansing member 6 is configured to remove residual toner from the photoconductive drum 1 after a toner image formed on the photoconductive drum 1 has been transferred onto the intermediate transfer belt 5. The toner removed from the cleansing member 6 is collected by a collecting chamber 26 (26*a* to 26*d*) for the removed toner.

The charging roller 2 is configured to uniformly charge a surface of the photoconductive drum 1. After the surface of the photoconductive drum 1 has been charged by the charging roller 2, the surface of the photoconductive drum 1 is exposed to laser light through a unit opening 32 (32*a* to 32*d*) by a scanner unit (an exposure portion) 3. In this manner, an electrostatic latent image corresponding to image data is formed on the surface of the photoconductive drum 1. Note that in this embodiment, the scanner unit 3 is disposed below the image formation portion 7.

The development unit 4 is configured to supply toner to the electrostatic latent image formed on the photoconductive drum 1, thereby developing the electrostatic latent image as a toner image. The development unit 4 includes a development roller 25 (25*a* to 25*d*) configured to contact the photoconductive drum 1 to supply toner to the surface of the photoconductive drum 1, and a supply roller 34 (34*a* to 34*d*) configured to contact the development roller 25 to supply a toner agent to the development roller 25.

When an image is formed on the recording medium S, an electrostatic latent image is first formed on the surface of the photoconductive drum 1 by the scanner unit 3, and then, the formed electrostatic latent image is developed as a toner image by the image formation portion 7. Then, the toner image developed on the photoconductive drum 1 is transferred onto the intermediate transfer belt 5 by a primary transfer roller 12 (12*a* to 12*d*) as a primary transfer portion.

The intermediate transfer belt 5 is stretched around a drive roller 10 and a tension roller 11, and is configured to rotate in an arrow R direction in FIG. 2.

The primary transfer roller 12 is, on the inside of the intermediate transfer belt 5, disposed to face each photoconductive drum 1 with the intermediate transfer belt 5 being interposed therebetween. A transfer bias is applied to the primary transfer roller 12 by a not-shown bias application unit. For example, in the case of using toner charged to a negative polarity, a bias of a positive polarity is applied to the primary transfer roller 12, and in this manner, a toner image is primarily transferred onto the intermediate transfer belt 5. Then, toner images in the four colors are sequentially transferred onto the intermediate transfer belt 5 such that the toner images overlap with each other. The toner image transferred onto the intermediate transfer belt 5 is conveyed to a secondary transfer portion 15 by the intermediate transfer belt 5.

At the secondary transfer portion 15, the toner image on the intermediate transfer belt 5 is transferred onto the recording medium S by a secondary transfer roller 18 as a secondary transfer portion.

Residual toner on the intermediate transfer belt 5 after secondary transfer onto the recording medium S is removed by a cleaning device 23. The removed toner passes through a waste toner conveyance path (not shown), and then, is collected to a waste toner collecting container (not shown).

Meanwhile, the recording medium S is, in synchronization with the above-described image formation operation, fed to the secondary transfer portion 15 by a conveyance mechanism 406 (FIG. 10) including a feeding device 13, a pair of registration rollers 17, etc.

The feeding device 13 has a cassette 24 configured to store a plurality of recording media S, a feeding roller 8 configured to feed each recording medium S out of the cassette 24, and a pair of conveyance rollers 16 configured to convey each recording medium S fed out by the feeding roller 8.

An operator resupplies recording media S to be stored in the cassette 24.

Of the recording media S stored in the cassette 24, the uppermost recording medium S is in pressure-contact with the feeding roller 8. In response to rotation of the feeding roller 8, the recording media S are, one by one, separated and conveyed by a separation pad 9.

Then, the recording medium S conveyed from the feeding device 13 is conveyed to the secondary transfer portion 15 by the pair of registration rollers 17. At the secondary transfer portion 15, the bias of the positive polarity is applied to the secondary transfer roller 18, and in this manner, the toner images in the four colors can be secondarily transferred from the intermediate transfer belt 5 onto the conveyed recording medium S.

The recording medium S on which the toner image is formed at the secondary transfer portion 15 is conveyed to a fixing device 40 as a fixing portion. At the fixing device 40, the image is fixed onto the recording medium S (onto the recording medium) by application of heat and pressure to the image transferred onto the recording medium S while the recording medium S is being conveyed at a nip portion N.

The recording medium S onto which the toner image is fixed by the fixing device 40 is, by a pair of discharge rollers 19, discharged to a discharge tray 20 provided on the outside of the housing 501.

The fixing device 40 of the present embodiment is a film heating fixing device using a fixing film (a film) 101, the fixing film 101 being configured such that an elastic layer is formed on a cylindrical thin metal base layer.

[Configuration of Fixing Device]

Next, a configuration of the fixing device 40 will be described.

Figure 3:
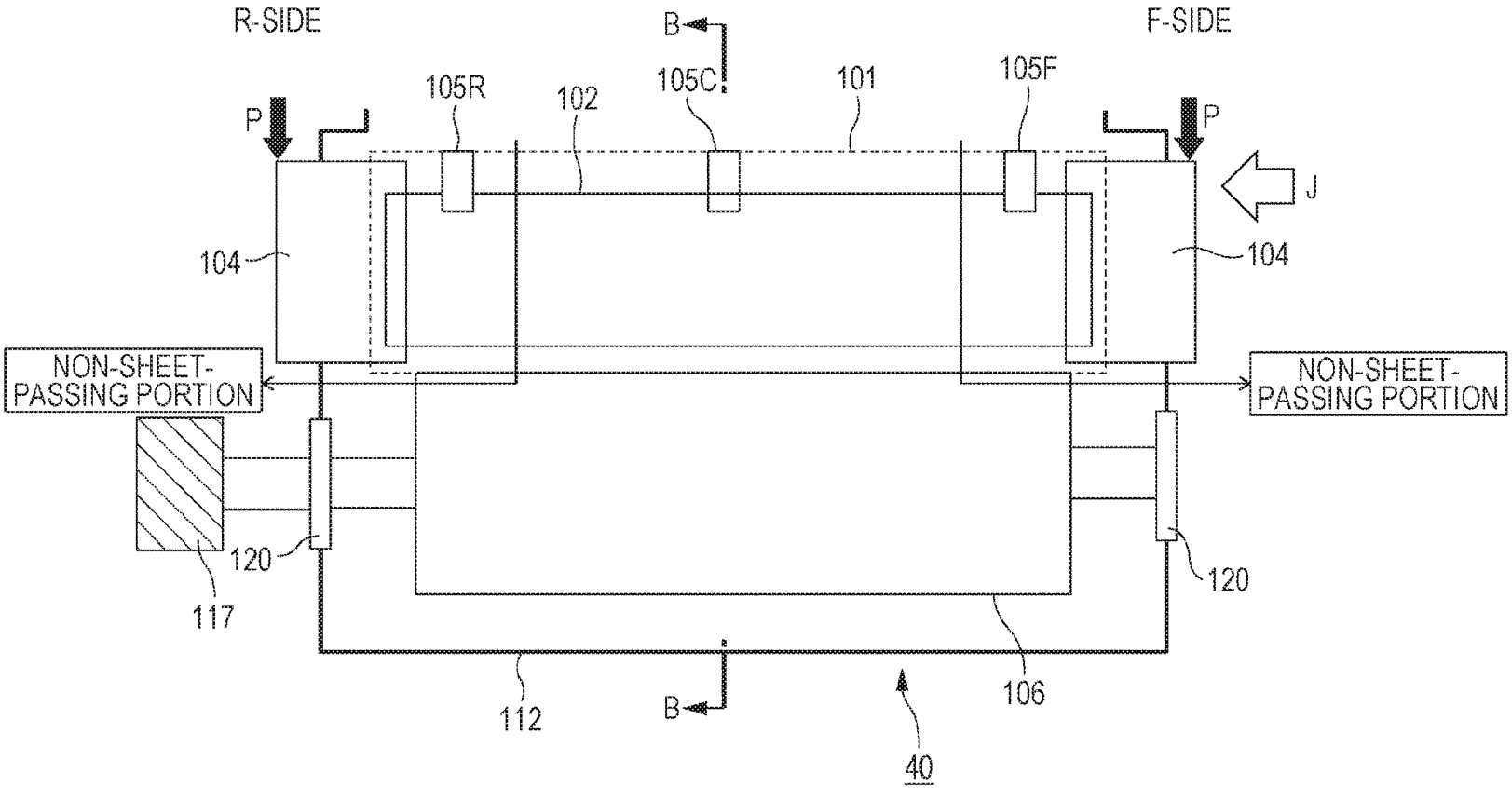
FIG. 3 is an A-A sectional view of an example of a configuration of a fixing device.
Figure 4:
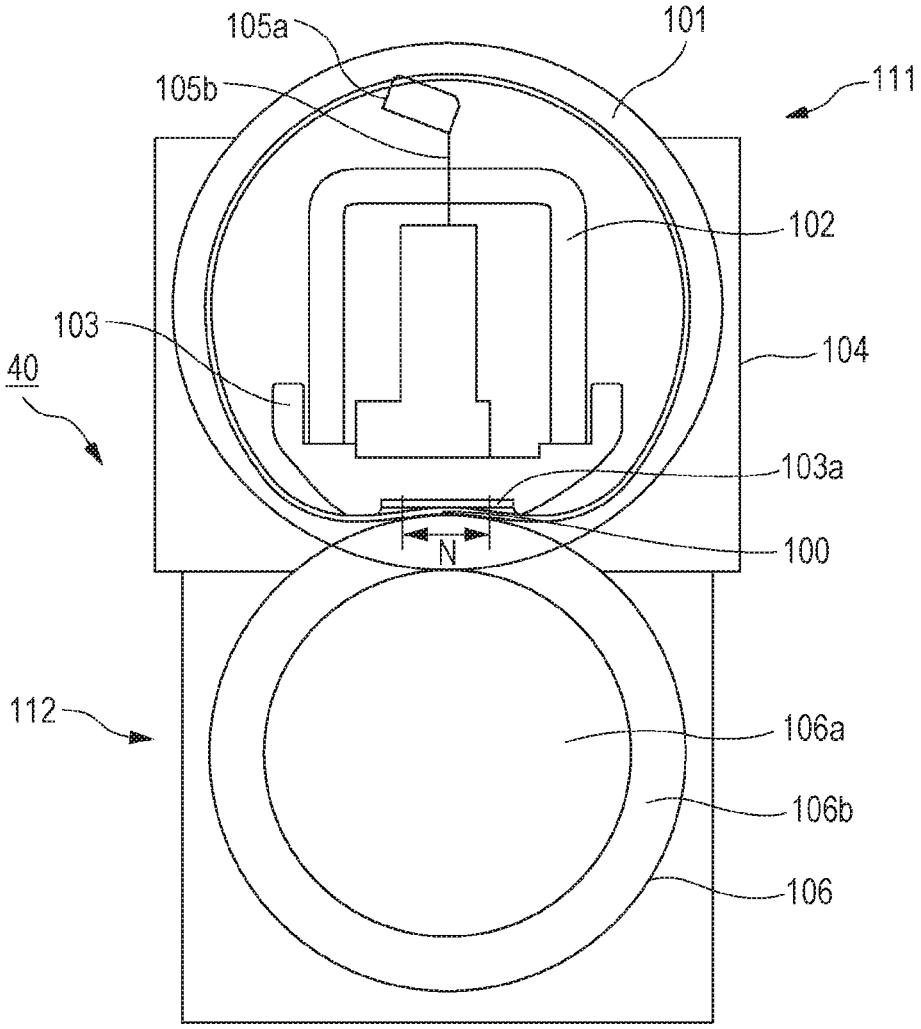
FIG. 4 is a B-B sectional view of the example of the configuration of the fixing device.

FIG. 3 is an A-A sectional view of an example of the configuration of the fixing device. FIG. 4 is a B-B sectional view of the example of the configuration of the fixing device. FIG. 3 illustrates a state of the fixing device 40 along a cut line A-A illustrated in FIG. 2, FIG. 3 being a view of a longitudinal direction of the fixing device 40 from an upstream side of the recording medium S in a conveyance direction thereof. An F-side in FIG. 3 is a side positioned on the front side of the image formation device 500 in the case of attaching the fixing device 40 to the image formation device 500. An R-side in FIG. 3 is a side positioned on a back side of the image formation device 500 in the case of attaching the fixing device 40 to the image formation device 500. FIG. 4 illustrates a state along a cut line B-B illustrated in FIG. 3.

The fixing device 40 includes a pressing roller (a rotary member) 106, a ceramic heater 100 as a heating member, and the cylindrical fixing film 101 as a fixing member. The fixing device 40 includes a pressing pad (a pad) 103 for forming the nip portion N between the fixing film 101 and the pressing roller 106, and a stay 102 disposed on the inside of the fixing film 101 for ensuring the strength of the pressing pad 103. The fixing device 40 includes a fixing flange 104 configured to restrict the amount of movement in a longitudinal direction of the fixing film 101. Moreover, the fixing device 40 includes thermistors 105F, 105C, 105R functioning as sensors (temperature detecting portions) configured to detect the temperature of the fixing film 101.

The fixing device 40 is configured as a unit, and is detachably provided at an attachment portion 502 in the image formation device 500. Upon component replacement in the fixing device 40, the whole unit of the fixing device 40 is removed to the outside of the image formation device 500.

Moreover, a portion of the fixing device 40 is configured as a film unit 111. The fixing film 101, the ceramic heater 100, the pressing pad 103, the stay 102, the fixing flange 104, and the thermistors 105F, 105C, 105R are hereinafter collectively referred to as the film unit 111.

[Pressing Roller]

The pressing roller 106 is a roller having, about a core bar 106*a* made of metal, an elastic material layer (an elastic layer) 106*b* exhibiting heat resistance. Moreover, the pressing roller 106 may be configured such that a release layer is provided at a surface layer of the elastic layer 106*b*. For example, silicone rubber, fluoro rubber, fluoro plastic, etc. can be used as the elastic layer 106*b*. For examples, a material exhibiting favorable releasability and heat resistance, such as fluoro plastic, silicone plastic, fluoro silicone rubber, fluoro rubber, silicone rubber, PFA, PTFE, and FEP, can be selected as the release layer.

A bearing member 120 made of heat resistant plastic such as PEEK, PPS, or liquid crystal polymer is attached to each end portion of the core bar 106*a*. The bearing member 120 is held at a side plate of a fixing frame 112 and supports the core bar 106*a* rotatably. Note that the fixing frame 112 is a side plate for holding the members in the fixing device 40.

The pressing roller 106 is rotated in such a manner that driving from a motor 118 (FIG. 10) attached to the inside of the image formation device 500 is transmitted through a gear 117. The fixing film 101 follows the pressing roller 106, thereby rotating counterclockwise in FIG. 4. That is, the pressing roller 106 rotates the fixing film 101.

A configuration of a pressing mechanism 119 will be described later in detail in [Pressing Mechanism].

[Fixing Film]

The fixing film (an endless belt) 101 is a cylindrical heat resistant film (an endless belt), and is loosely fitted onto the pressing pad 103. The fixing film 101 is heated by the later-described ceramic heater 100, thereby heating the recording medium S passing through the nip portion N.

The fixing film 101 includes, on the outside of the base layer containing metal such as SUS or nickel, the elastic layer (e.g., a silicone rubber layer) and the release layer (e.g., a PFA plastic tube).

For decreasing a heat capacity to improve quick start performance, the fixing film 101 has a film thickness of equal to or less than 100 μm, and preferably equal to or less than 50 μm and equal to or greater than 20 μm. In the present embodiment, the thickness of the fixing film 101 is 40 μm.

The fixing flange 104 is fitted between an assembly of the pressing pad 103 and the stay 102 and the fixing film 101 at each end portion of the fixing film 101 in the longitudinal direction thereof. The fixing flange 104 guides the rotational trajectory of the fixing film 101, and restricts the position of the fixing film 101 in the longitudinal direction thereof.

The fixing film 101 sometimes moves, due to rotation thereof, toward one side of the fixing film 101 in the longitudinal direction thereof. For example, due to variation in components or assemblies, relative misalignment between the pressing roller 106 and the fixing film 101 is caused.

The fixing flange 104 has a surface contacting an end surface of the fixing film 101 in the case of moving the fixing film 101 in the longitudinal direction thereof. Such an end surface contacts the end surface of the fixing film 101, and in this manner, movement of the fixing film 101 in the longitudinal direction thereof is restricted.

The film unit 111 and the pressing roller 106 are pressed by the later-described pressing mechanism 119. Specifically, as illustrated in FIG. 3, the pressing mechanism 119 applies pressing force in an arrow P direction to the fixing flange 104 disposed at each end portion of the fixing film 101. Thus, the pressing force is applied to the assembly of the pressing pad 103 and the stay 102 through the fixing flange 104, and therefore, the pressing pad 103 is pressed toward the pressing roller 106. As a result, the nip portion N between the fixing film 101 and the pressing roller 106 is pressurized.

[Pressing Pad]

The pressing pad (a nip formation member) 103 serves to back up the fixing film 101, press the nip portion N formed by the fixing film 101 and the pressing roller 106, and provide conveyance stability upon rotation of the fixing film 101.

The pressing pad 103 is, on the inside of the fixing film 101, provided to cover a sheet passing area of the recording medium S in a direction (hereinafter referred to as a "width direction") perpendicular to the conveyance direction of the recording medium S. The pressing pad 103 is formed of a heat resistant/adiabatic member. For example, a material exhibiting favorable adiabaticity and heat resistance is used, such as phenol plastic, polyimide plastic, polyamide plastic, polyamide-imide plastic, PEEK plastic, PES plastic, PPS plastic, PFA plastic, PTFE plastic, and LCP plastic.

[Stay]

The stay 102 is a member configured to provide a longitudinal strength to the relatively-soft plastic pressing pad 103 by pressing against a back surface of the pressing pad 103 and to reduce warping of the pressing pad 103 which might be caused due to pressing. The stay 102 is made of metal, for example.

[Heater]

The ceramic heater 100 (hereinafter referred to as a "heater 100") is a heating portion configured to heat the fixing film 101. The heater 100 includes, as a basic configuration, a thin plate-shaped ceramic board elongated in the width direction of the recording medium S, and a heat generating resistor layer provided on a board surface. The heater 100 is a low-heat-capacity heater configured to entirely increase a temperature with steep rise characteristics by energization to the heat generating resistor layer.

A lower surface (a surface close to the pressing roller 106) of the pressing pad 103 is provided with a fitting groove 103*a* along a longitudinal direction of the pressing pad 103. The heater 100 is supported by being fitted in the fitting groove 103*a*.

Note that in the present embodiment, the ceramic heater 100 is used as the heating portion, but the present disclosure is not limited to such a heater. For example, it may be configured such that a halogen heater is used as the heating portion or that heat is generated from the fixing film 101 by an IH method.

[Thermistor]

The thermistors 105F, 105C, 105R are the sensors configured to detect the temperature of the fixing film 101. The thermistors 105F, 105C, 105R are contact sensors, and are provided in contact with an inner circumferential surface of the fixing film 101. The thermistors 105F, 105C, 105R each include a temperature detection element portion 105*a* configured to contact an inner surface of the fixing film 101 to detect the temperature, and a plate spring portion 105*b* configured to bias, with predetermined contact pressure, the temperature detection element portion 105*a* against the fixing film 101. Such a plate spring is made of stainless steel, and also forms a conduction path of the temperature detection element.

Note that it may be configured such that a non-contact sensor is used as a unit configured to detect the temperature of the fixing film 101, the non-contact sensor facing the fixing film 101.

The thermistor 105F detects the temperature of the fixing film in an F-side end area (an end portion on one side) of the fixing film 101 in the longitudinal direction thereof. The thermistor 105R detects the temperature of the fixing film in an R-side end area (an end portion on the other side) of the fixing film 101 in the longitudinal direction thereof.

Note that the end area of the fixing film 101 means, in the longitudinal direction of the fixing film 101, the outside of an area where the recording medium S with the minimum width passable through the nip portion N passes. The recording medium S with the minimum width passable through the nip portion N as described herein is a recording medium S with the smallest size in the width direction among various recording media S which can be subjected to fixing processing at the fixing device 40. Note that the positions of the thermistors 105F, 105R may be on the inside of the sheet passing area of the recording medium S with the maximum width passable through the nip portion N. A non-sheet-passing area in FIG. 3 indicates an area where the fixing film 101 does not contact the recording medium S when the recording medium S with the minimum width passes through the nip portion N.

In the present embodiment, the thermistor 105F and the thermistor 105R are arranged at symmetrical positions in the longitudinal direction with respect to a center portion of the fixing film 101 in the longitudinal direction thereof. Specifically, when the center of the maximum sheet passing area of the fixing film 101 is taken as a reference point, the thermistor 105F is provided at a position away from the center to the F-side by 153 mm, and the thermistor 105R is provided at a position away from the center to the R-side by 153 mm. The image formation device 500 of the present embodiment employs sheet passing with reference to the center in the width direction.

The thermistor 105C detects the temperature of the fixing film in a center area of the fixing film 101 in the longitudinal direction thereof.

Note that the center area of the fixing film 101 means, in the longitudinal direction of the fixing film 101, an area where all recording media S passable through the nip portion N are passable.

In the present embodiment, the thermistor 105C is, as an example, provided at the center of the maximum sheet passing area of the fixing film 101 in the width direction.

The thermistor 105C is a thermistor serving to control temperature adjustment for the fixing device 40. A CPU 301 (FIG. 10) is configured to control energization to the heater 100 based on the detection temperature of the thermistor 105C such that the fixing film 101 maintains at a predetermined temperature (e.g., 180° C.)

[Pressing Mechanism]

The pressing mechanism 119 configured to press the film unit 111 and the pressing roller 106 will be described with reference to FIGS. 5A and 5B.

Figure 5A:
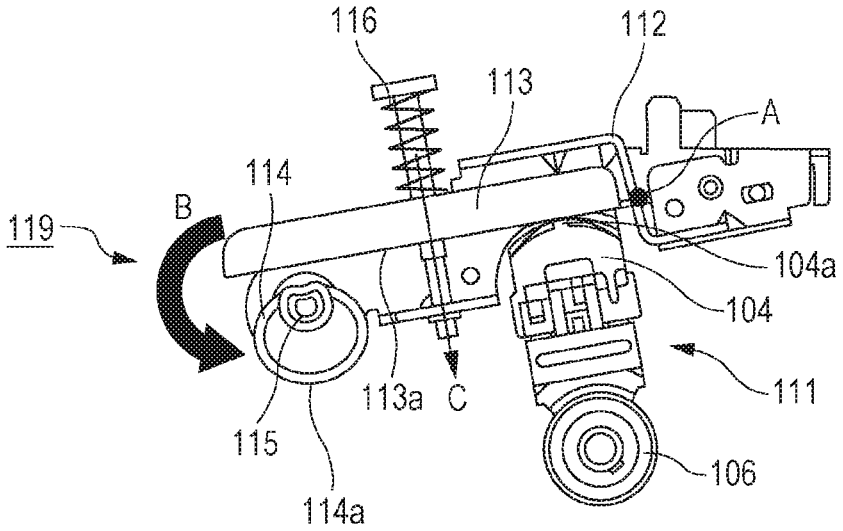
FIGS. 5A and 5B are views of an example of a configuration of a pressing mechanism of the fixing device.
Figure 5B:
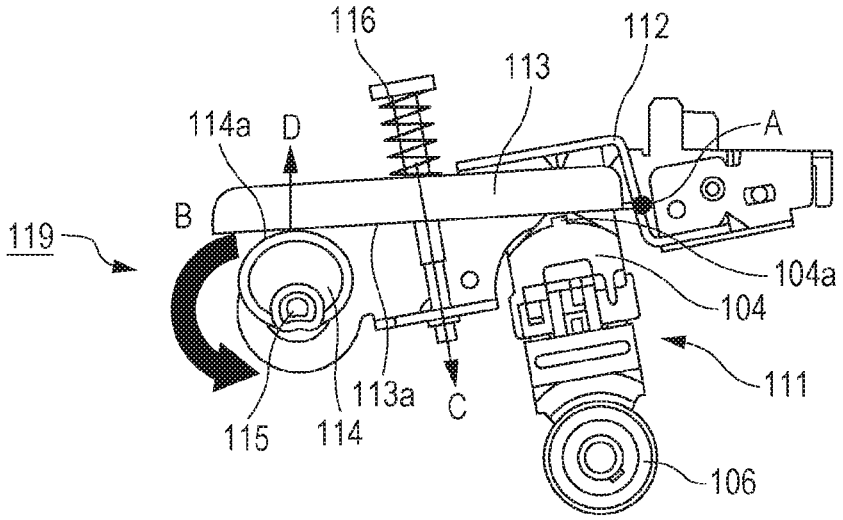

FIGS. 5A and 5B are views of an example of the configuration of the pressing mechanism of the fixing device. FIGS. 5A and 5B illustrate a state when the fixing device 40 is viewed in an arrow J direction in FIG. 3. FIG. 5A illustrates a pressed state. FIG. 5B illustrates a pressure release state in which the pressure on the nip portion N is released.

The pressing mechanism 119 includes a pressing plate 113, a pressing spring 116, a cam 114, a shaft 115, and a motor. The pressing mechanism 119 is a mechanism configured to change the relative positions of the pressing pad 103 and the pressing roller 106 between a position at which the pressed state is brought and a position at which the pressure release state is brought. Note that definitions of the pressed state and the pressure release state will be described later.

The pressing plate 113 is supported on the fixing frame 112 to rotate about a fulcrum A.

In the pressed state illustrated in FIG. 5A, the pressing plate 113 receives force in an arrow C direction of the figure (i.e., the direction of pressing the pressing pad 103 against the pressing roller 106) by the pressing spring 116 as a compression spring. By spring force of the pressing spring 116, a surface 104*a* of the fixing flange 104 receives force from a surface 113*a* of the pressing plate 113, and therefore, the film unit 111 and the pressing roller 106 are pressed.

The shaft 115 is rotatably attached to the fixing frame 112. The cam 114 is held by being fitted onto the shaft 115. In the pressed state, a cam surface 114*a* of the cam 114 does not contact the surface 113*a* of the pressing plate 113, and because of the spring force of the pressing spring 116, the surface 104*a* of the fixing flange 104 receives the force from the surface 113*a* of the pressing plate 113.

The pressed state is a state in which pressure sufficient for fixing toner onto the recording medium S is applied to the nip portion N, and the pressing mechanism 119 is in the pressed state upon execution of the fixing processing. For example, in the present embodiment, a total pressure of 196 N is applied to the nip portion N in the pressed state.

Next, the state (the pressure release state) in which pressing force between the film unit 111 and the pressing roller 106 is released will be described with reference to FIG. 5B.

The cam 114 rotates about the shaft 115 in an arrow B direction of the figure. The shaft 115 is connected to the motor (not shown), and the cam 114 is rotated in such a manner that the shaft 115 is rotated by the motor. When the pressed state of FIG. 5A is switched to the pressure release state of FIG. 5B, the motor of the pressing mechanism 119 rotates the shaft 115 such that the cam 114 rotates about the shaft 115 in the arrow B direction of the figure. Thus, the cam surface 114*a* of the cam 114 pushes up the surface 113*a* of the pressing plate 113 in an arrow D direction of the figure.

In the pressure release state, the cam surface 114*a* pushes up the surface 113*a* of the pressing plate 113 in the arrow D direction of the figure. The cam surface 114*a* receives the spring force from the pressing spring 116, leading to a state in which no spring force from the pressing spring 116 is applied to the fixing flange 104.

In the pressure release state, the pressure on the nip portion N is released. For example, in the present embodiment, the pressing pad 103 and the pressing roller 106 are separated from each other in the pressure release state.

In the present embodiment, when, e.g., jam is caused at the fixing device 40, the pressing mechanism 119 is in the pressure release state so that the operator can easily perform jam processing (removal of the remaining recording medium S) for the recording medium S remaining at the nip portion N. Note that as described later, the case of detecting a fixing film crack is excluded.

Note that it may be configured such that in the pressure release state, the pressing pad 103 and the pressing roller 106 are not fully separated from each other. That is, it may be configured such that the pressing pad 103 and the pressing roller 106 forms, through the fixing film 101, the nip portion N with light pressure (e.g., a total pressure of 29.4 N). In the present embodiment, as long as the later-described definition of the pressure release state is satisfied, the case of forming the light-pressure nip portion N is also referred to as the "pressure release state."

The motor of the pressing mechanism 119 is electrically connected to the CPU 301. The CPU 301 operates the motor to determine the position of the cam 114. Thus, the pressing mechanism 119 can be brought into the pressed state in which the pressing plate 113 applies the pressing force to the fixing flange 104 or the pressure release state in which the pressing force is released.

Note that the pressing mechanism 119 on one side of the fixing device 40 in the longitudinal direction thereof has been described above, but the same applies to the other side. The pressing mechanism 119 also includes, on the other side, a pressing plate, a pressing spring, and a cam. The shaft 115 is also connected to the cam on the other side. The motor rotates the shaft 115 to simultaneously rotate the cams 114 at both ends. Thus, the pressing mechanisms at both ends can be simultaneously brought into the pressed state or the pressure release state.

[Configuration for Control]

Figure 10:
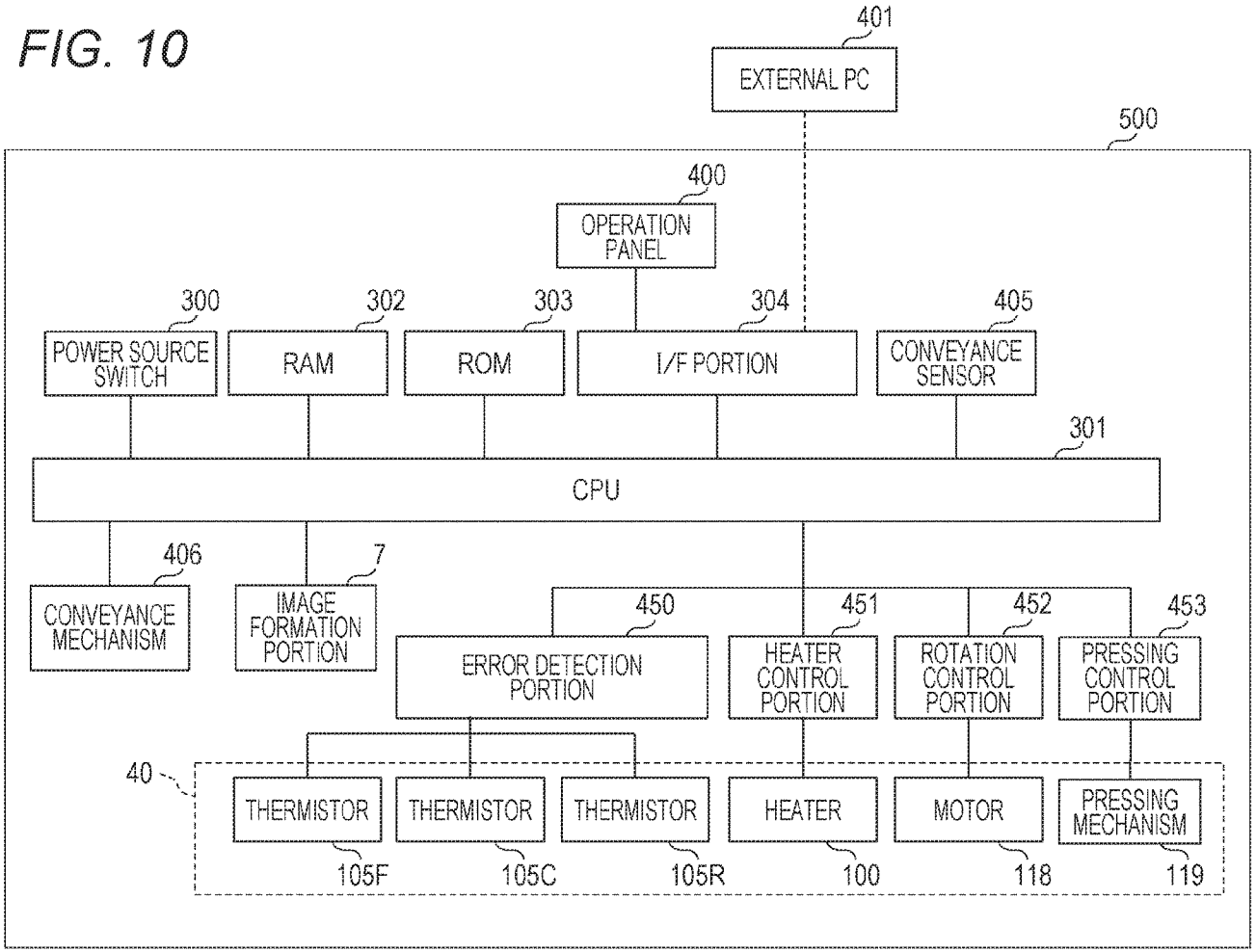
FIG. 10 is a block diagram of an example of a configuration for control.

FIG. 10 is a block diagram of an example of a configuration for control.

For controlling operation of the image formation device 500, the image formation device 500 (FIG. 1) includes the CPU 301, a RAM 302, a ROM 303, etc.

The CPU 301 functioning as a control portion is configured to execute a control program stored in the ROM 303, thereby performing basic control for the image formation device 500. Operation in flowcharts as described later is executed by the CPU 301 based on the control program stored in the ROM 303. The CPU 301 uses the RAM 302 as a work area for executing control program processing.

As illustrated in FIG. 10, the CPU 301 is, in addition to the RAM 302 and the ROM 303, electrically connected to each mechanism targeted for control.

A power source switch 300 is a main switch for applying power to the image formation device 500. The power source switch 300 is a hard switch. The power source switch 300 is switchable between an ON state for powering ON the image formation device 500 and an OFF state for powering OFF the image formation device 500. When the operator switches the power source switch 300 from the OFF state to the ON state, the power is supplied to the image formation device 500, and therefore, the CPU 301 is started up. When the power source switch 300 is switched from the ON state to the OFF state, the CPU 301 performs preparatory operation for power-off, and then, powers OFF the image formation device 500 (i.e., a power supply to the image formation device 500 is stopped).

An I/F portion 304 is electrically connected to an operation panel 400. The I/F portion 304 receives input from the operation panel 400, thereby transmitting the input information to the CPU 301 and displaying the information on the operation panel 400 based on a signal from the CPU 301. Moreover, the I/F portion 304 communicates with a connected external PC 401 through a network (e.g., a LAN or a WAN). The CPU 301 can execute image formation based on image information input from the connected external PC.

Figure 8:
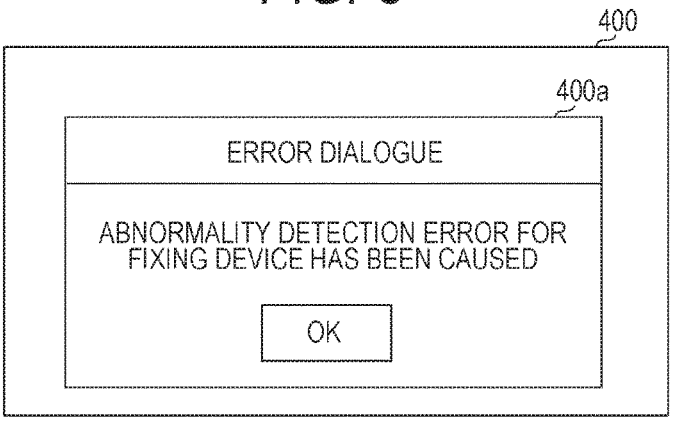
FIG. 8 is a view of an example of a screen for informing the error.

The operation panel 400 functions as an input unit to which various types of information are input by the operator and a display unit configured to display the information. In the present embodiment, the operation panel 400 includes, as illustrated in FIG. 8, an operation screen 400*a* as a touch-panel liquid crystal screen. The operation screen 400*a* displays various messages, as well as displaying various operation buttons (keys). Note that the operation panel 400 may include an operation button portion to which an instruction is input by the operator, and a display portion (an information display portion) configured to display various messages etc.

Conveyance sensors 405 are a plurality of sensors provided on the conveyance path of the recording medium S in the image formation device 500, and are configured to detect the recording medium S on the conveyance path. For example, optical sensors are used. The CPU (a jam detecting portion) 301 is configured to detect occurrence of jam based on signals output from the conveyance sensors 405. For example, when the downstream conveyance sensor in the conveyance direction does not detect passing of the recording medium S even after a lapse of a predetermined time from detection of passing of the recording medium S by the upstream conveyance sensor, the CPU 301 determines that the recording medium S remains between these conveyance sensors (i.e., jam has occurred). The CPU 301 can detect occurrence of jam at the fixing device 40 based on detection results of the conveyance sensors 405.

The conveyance mechanism 406 includes, for example, the feeding device 13 and the pair of registration rollers 17 as described above. The CPU 301 controls conveyance of the recording medium S.

Moreover, the CPU 301 is connected to the image formation portion 7, and causes the image formation portion to form an image corresponding to the input image information.

In the present embodiment, the CPU 301 executes the program stored in the ROM 303, thereby realizing functions of an error detection portion (an error detecting portion) 450, a heater control portion 451, a rotation control portion 452, a pressing control portion 453, etc.

The error detection portion 450 is connected to the thermistors 105F, 105C, 105R, thereby detecting the temperature of the fixing film 101. Moreover, the CPU 301 detects, as described later, occurrence of the crack of the fixing film 101 through the error detection portion 450.

The heater control portion 451 is connected to the heater 100 of the fixing device 40, thereby controlling heater output such that the fixing film 101 is maintained at the predetermined temperature.

The rotation control portion 452 is connected to the motor 118 of the fixing device 40, thereby controlling rotation of the pressing roller 106.

The pressing control portion 453 is connected to the pressing mechanism 119 of the fixing device 40 (more specifically, the motor of the pressing mechanism 119), thereby switching the pressing mechanism 119 to the pressed state or the pressure release state and maintaining such a state. For example, the pressing control portion 453 brings the pressing mechanism 119 into the pressure release state when jam occurs at the fixing device 40. Note that as described later, the case of detecting the fixing film crack is excluded.

Note that the above-described configuration for control may be a configuration in which a single CPU 301 fulfills multiple functions (e.g., the error detection portion and the pressing control portion) to control the entirety of the image formation device 500, or a configuration in which multiple CPUs or control circuits are provided respectively for functions.

[Detection of Fixing Film Crack]

The method for detecting occurrence of the crack when the crack occurs at the fixing film 101 during sheet passing (e.g., during execution of continuous printing for 100 sheets of A4-size recording media S with a paper weight of 105 gsm) in the fixing device 40 will be described.

Figure 6:
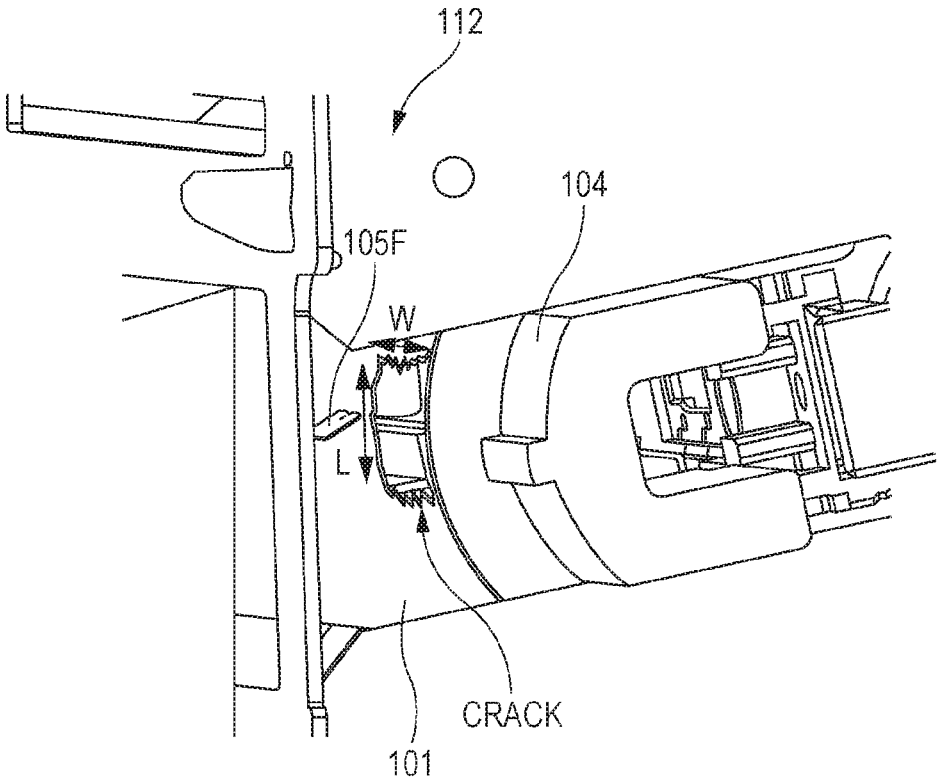
FIG. 6 is a view of an example of a state of the fixing film crack.

FIG. 6 is a view of an example of a state of the fixing film crack. FIG. 6 illustrates a state of an F-side end portion of the fixing device 40. In the present embodiment, a case where the crack occurs only at the F-side end portion of the fixing film 101 as illustrated in FIG. 6 will be described.

The longitudinal crack length of the fixing film 101 is W, and the circumferential crack length of the fixing film 101 is L.

When the end surface of the fixing film 101 moved toward the F-side is continuously rubbed against the fixing flange 104 for a long time, there is a probability that the crack occurs at the end portion of the fixing film 101. When the crack occurs at the fixing film 101 during sheet passing and the length W of the crack expanded in the longitudinal direction reaches the position of the thermistor 105F, the thermistor 105F leads to contact failure of the cracked portion in a circumferential direction of the fixing film 101. Specifically, the thermistor 105F contacting the inner surface of the fixing film 101 is exposed through the cracked portion of the fixing film 101. As a result, the detection temperature of the thermistor 105F rapidly decreases as compared to that before the crack length reaches the thermistor 105F. Details of the detection temperature will be described later with reference to FIG. 9.

On the other hand, the thermistor 105R placed on the opposite side of the thermistor 105F in the longitudinal direction of the fixing film 101 continuously detects the temperature of the inner surface of the fixing film 101 subjected to constant temperature adjustment by the heater 100. Thus, the detection temperature of the thermistor 105R is maintained at a substantially constant temperature (e.g., about 190° C.)

As described above, a temperature difference between the thermistor 105F and the thermistor 105R increases due to occurrence of the crack. Thus, when the time rate of change in the temperature difference is greater than a predetermined value, the error detection portion 450 determines that the crack has occurred. In this manner, the error detection portion 450 detects occurrence of the crack.

Specifically, when the temperature difference (a detection temperature difference) between the thermistor 105F and the thermistor 105R is ΔT (° C.) and the amount of change in ΔT exceeds 10° C. in one second, it is determined that the crack has occurred. The amount of change in ΔT per second (per unit time) is herein represented by ΔT/s (in units of ° C./second). When ΔT/s exceeds a predetermined value, i.e., ΔT/s>10 (° C./second) is satisfied in the present embodiment, it is determined that the crack has occurred.

Note that the method for detecting the crack may be a method in which an absolute value of the temperature difference between the thermistor 105F and the thermistor 105R is taken. Note that the above-described method for detecting the crack based on the time rate of change in the temperature difference is more preferable than such a method because the former method leads to less erroneous detection. In the method using the absolute value of the temperature difference between the thermistor 105F and the thermistor 105R, when the entrance position of the recording medium S into the nip portion N is closer to one side of the fixing film 101 with respect to a reference sheet passing position, there is a probability that erroneous detection occurs. This is because even when no crack occurs at the fixing film 101, the temperature difference between the thermistor 105F and the thermistor 105R reaches a predetermined value, it is erroneously detected that the crack occurs at the fixing film 101. The change in temperature difference between the thermistor 105F and the thermistor 105R due to occurrence of the crack is steep. For this reason, erroneous detection can be prevented based on the time rate of change while occurrence of the crack can be detected.

[Detection Control Flowchart]

Next, the control of detection of occurrence of the crack of the fixing film 101 in the present embodiment will be described with reference to the flowchart of FIG. 7. Note that control for other components than the fixing device 40 in the present embodiment will not be described herein.

Figure 7:
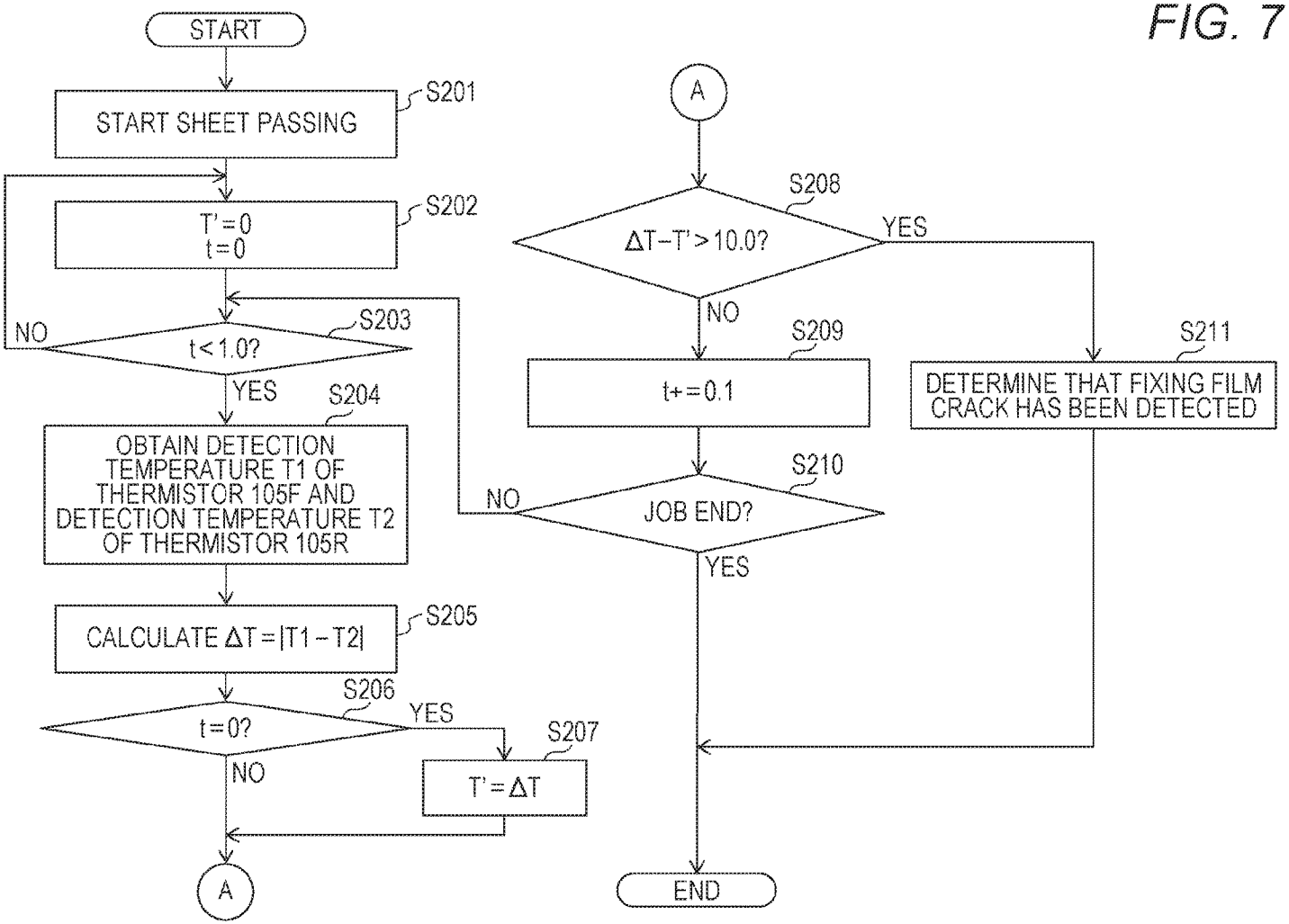
FIG. 7 is an example of a flowchart regarding detection of the fixing film crack.

The flowchart of FIG. 7 is a flowchart corresponding to later-described processing (the control of detection of the fixing film crack) of S105 of FIG. 1.

When receiving job input in a standby state for subsequent job input, the CPU 301 brings the fixing device 40 into the pressed state (S101 in FIG. 1), and energizes the heater 100. In addition, the CPU 301 starts up the fixing device 40 to heat the fixing film 101 to a target temperature (S102 in FIG. 1). Then, the CPU 301 starts rotation of the pressing roller 106 (S103 in FIG. 1). Subsequently, the CPU 301 checks whether or not the thermistors 105F, 105C, 105R are normally operated (S104 in FIG. 1). When normally operated, the flowchart of FIG. 7 begins.

Note that a job (an image formation job) is an image formation instruction to which printing condition information such as image data and the type, the paper weight, the size, the number of sheets, the number of copies, the layout, and the post-processing of a selected recording medium S is added.

Figure 1:
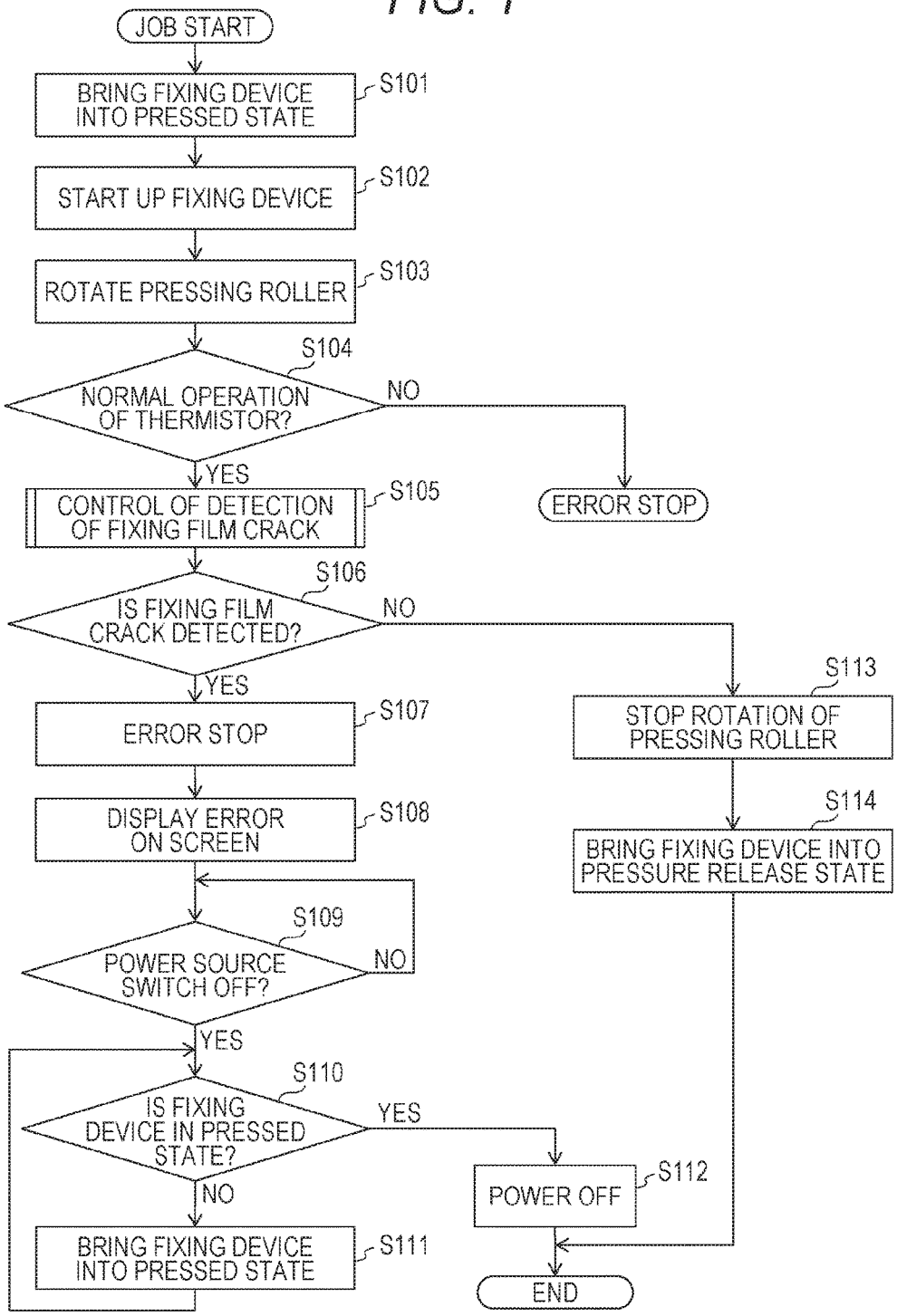
FIG. 1 is an example of a flowchart regarding an error due to a fixing film crack.

At S104 in FIG. 1, when confirming that the thermistors 105F, 105C, 105R are normally operated, the CPU 301 starts sheet passing through the fixing device 40 (S201).

Regarding the control of detecting occurrence of the crack of the fixing film 101 in the present embodiment, the CPU 301 acquires data on the temperature difference (the detection temperature difference) ΔT every 0.1 seconds, and determines whether or not the change amount in ΔT exceeds 10° C. in one second. That is, the data is acquired times in maximum in one second as a reference for determination. Moreover, the CPU 301 updates, every second, a default value T' as a reference for the change amount.

When sheet passing begins (S201), the CPU 301 defines, as T', a variable indicating the default value of the temperature difference between the thermistor 105F and the thermistor 105R, and assigns a default value T'=0. Moreover, the CPU 301 defines, as t (hereinafter referred to as an "elapsed time t"), an elapsed time counter, and assigns the default value t=0 (S202).

Next, when the elapsed time t is equal to or longer than one second, the CPU 301 proceeds to S202 (No at S203), and sets the elapsed time t to the default value t=0 (S202). On the other hand, when the elapsed time t is shorter than one second, the CPU 301 proceeds to S204 (Yes at S203).

Next, the CPU 301 acquires the detection temperature T1 of the thermistor 105F and the detection temperature T2 of the thermistor 105R (S204).

The CPU 301 calculates an absolute value of a difference between the detection temperatures T1, T2 acquired at S204. Such a value is taken as the temperature difference ΔT (S205).

Only upon t=0, i.e., the first attempt in one second (Yes at S206), the CPU 301 assigns ΔT calculated at S205 to the default value T' (S207). Such a value of T' is a reference value of the change amount in ΔT in one second. The CPU 301 uses the default value T' as the reference value in one second while the data is being acquired every 0.1 seconds. Thus, the CPU 301 does not update the value of T' at other attempts (t≠0) than the first attempt in one second (No at S206), and proceeds to S208.

The CPU 301 determines whether or not ΔT exceeds 10° C. with respect to T' (S208). When ΔT exceeds 10° C. with respect to T' (Yes at S208), the CPU 301 determines that the crack has occurred at the fixing film 101, and sets a flag (S211). Returning to the flowchart of FIG. 1, the CPU 301 proceeds to S107, and promptly stops operation of the image formation device 500 (S107 in FIG. 1).

At S208, when determining that ΔT does not exceed 10° C. with respect to T', the CPU 301 adds 0.1 seconds to the elapsed time t, and then, proceeds to S210 (S209).

At S210, when the image formation operation corresponding to the input job is completed, the CPU 301 ends the flowchart of the FIG. 7, and returns to the flowchart of FIG. 1.

At S210, when the image formation operation corresponding to the input job is not completed, the CPU 301 returns to S203.

As long as it is, at S208, not determined that the crack has occurred at the fixing film 101, the CPU 301 repeats S203 to S209 until the job is completed.

[Transition of Detection Temperatures of Thermistors in association with Detection of Fixing Film Crack]

Figure 9:
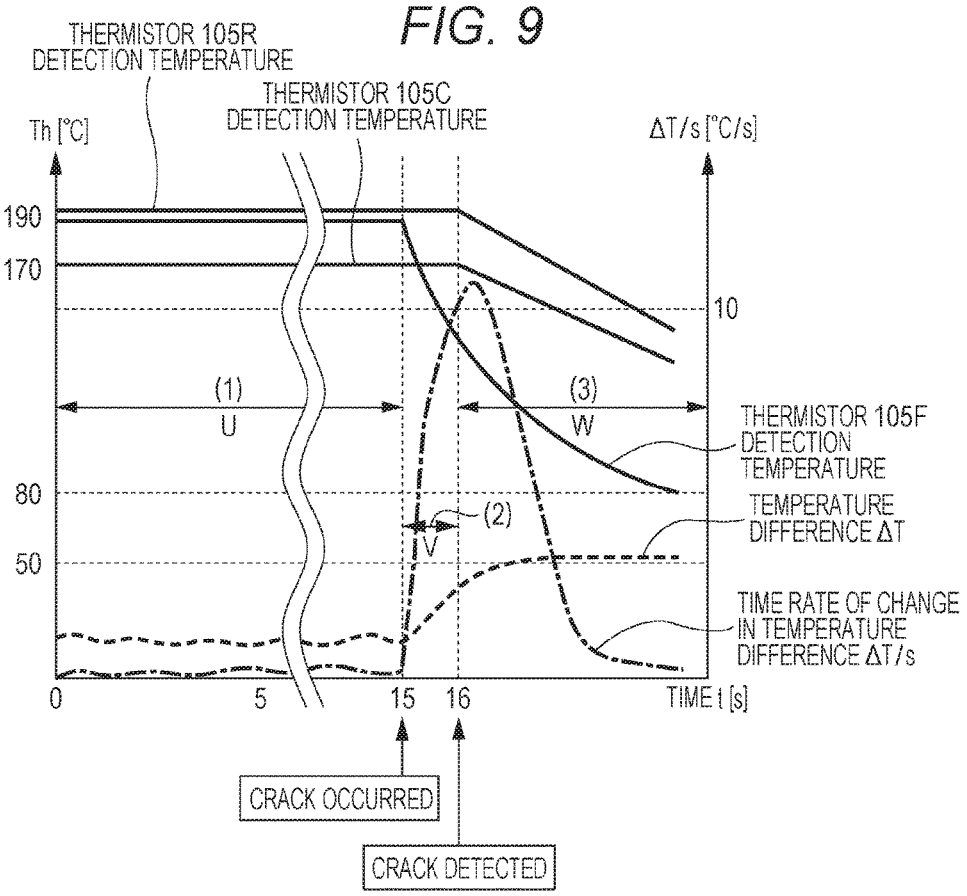
FIG. 9 is a graph for describing transition of detection temperatures of thermistors in response to occurrence of the fixing film crack.

Transition of the detection temperatures of the thermistors until abnormality of the fixing film 101 is detected based on the detection temperatures of the thermistors 105F, 105R after the crack has occurred at the fixing film 101 during sheet passing in the present embodiment will be described with reference to FIG. 9. FIG. 9 is a graph for describing transition of the detection temperatures of the thermistors in response to occurrence of the fixing film crack.

A solid line of the graph of FIG. 9 indicates the detection temperature of each of the thermistors 105F, 105R, 105C. Of two types of dotted graphs, one graph indicates the temperature difference ΔT between the detection temperatures of the thermistors 105F, 105R, and another graph indicates the change amount ΔT/s in ΔT per second. The horizontal axis indicates a time t [s]. The first vertical axis indicates the detection temperatures of the thermistors 105F, 105R, 105C and the temperature difference ΔT [° C.]. The second vertical axis indicates the value [° C./s] of the change amount ΔT/s in ΔT per second. FIG. 9 illustrates an example where the crack occurs at the time t=15 [s] and occurrence of the crack of the fixing film 101 is detected by the detection control shown in FIG. 7 at the time t=16 [s].

A period indicated by an arrow U in FIG. 9 indicates a state during sheet passing through the fixing device 40 with no crack occurred at the fixing film 101. The detection temperature of the thermistor 105C transitions in the vicinity of 170° C. as an adjusted temperature, and the detection temperatures of the thermistors 105F, 105R transition in the vicinity of 190° C. Moreover, the temperature difference ΔT in this state is within 5° C., and ΔT/s is within 1° C./s.

A period indicated by an arrow V in FIG. 9 indicates a period until the CPU 301 detects occurrence of the crack after the crack has occurred at the fixing film 101 during sheet passing. When the crack occurs at the F-side end portion of the fixing film 101 during sheet passing, the detection temperature of the thermistor 105F rapidly decreases. On the other hand, the detection temperature of the thermistor 105R at an end portion of the fixing film 101 on the R-side as the other side little changes, and therefore, the temperature difference ΔT and the change amount ΔT/s rapidly increase. The CPU 301 detects that the crack has occurred at the fixing film 101 at such timing (t=16 in FIG. 9) that ΔT/s exceeds 10° C./s.

A period indicated by an arrow W in FIG. 9 is a period after the CPU 301 has detected occurrence of the crack. As described later, the CPU 301 stops, in response to detection of occurrence of the crack, operation of the image formation device 500 including the heater 100 of the fixing device 40. This decreases the detection temperature of each of the thermistors 105F, 105R, 105C.

[Flowchart Regarding Error Due to Fixing Film Crack]

Next, control for an error due to the fixing film crack in the present embodiment will be described. FIG. 1 is the flowchart regarding the error due to the fixing film crack.

When detecting occurrence of the crack of the fixing film 101 during sheet passing, the image formation device 500 of the present disclosure urgently stops the image formation operation performed by the image formation device 500. In this state, the relative positions of the pressing pad 103 and the pressing roller 106 in the fixing device 40 are maintained in the pressed state such that the recording medium remaining at the nip portion N of the fixing device 40 is not easily pulled out of the fixing device 40 in response to stop of the device.

When receiving the job input in the standby state for the subsequent job input, the CPU 301 controls the pressing mechanism 119 to bring the fixing device 40 into the pressed state (S101). Then, the CPU 301 energizes the heater 100, and starts heating of the fixing film 101 (S102). The CPU 301 heats the fixing film 101 to the target temperature (e.g., 170° C. for starting the fixing processing) (start-up of the fixing device 40). According to a state in which the fixing film 101 reaches the predetermined temperature (e.g., 100° C.), the CPU 301 controls the motor 118 to start rotation of the pressing roller 106 (S103).

Subsequently, the CPU 301 checks whether or not the thermistors 105F, 105C, 105R are normally operated (S104). When normally operated, the CPU 301 proceeds to S105. When detecting abnormality of the thermistors 105F, 105C, 105R, the CPU 301 performs error stop, and does not start image formation corresponding to the job.

At S105, the CPU 301 executes the above-described flowchart of FIG. 7 (the control of detection of the fixing film crack).

When no crack of the fixing film 101 has been detected (a flag indicating detection of the crack of the fixing film 101 is not set) (No at S106), the CPU 301 proceeds to S113. The CPU 301 turns OFF energization of the heater 100, and stops rotation of the pressing roller 106 (S113). Then, the pressing mechanism 119 is controlled such that the fixing device 40 is brought into the pressure release state (S114). In the present embodiment, the case of not detecting the crack of the fixing film 101 through the flowchart of FIG. 7 is the case of terminating the job without detection of the crack of the fixing film 101. Thus, great pressure is not applied to the nip portion N. This can suppress a pressing mark from remaining at the fixing film 101 in the case of a long standby time until the subsequent job input (including the case of power-off after use of the device has been normally terminated).

On the other hand, in the case of detecting the crack of the fixing film 101 (the case of setting the flag indicating detection of the crack of the fixing film 101) (Yes at S106), the CPU 301 promptly stops operation of the image formation device 500 (S107). Specifically, the CPU 301 stops rotation of the pressing roller 106, and turns OFF energization of the heater 100. Moreover, the CPU 301 stops image formation performed by the image formation portion 7, as well as stopping conveyance of the recording medium S by the feeding device 13. That is, the image formation device 500 does not continue image formation with the crack remaining at the fixing film 101, and therefore, safety of the image formation device 500 can be sufficiently ensured. Note that for realizing safety rated one notch above, the CPU 301 preferably maintains the pressed state without bringing the fixing device 40 into the pressure release state.

At S108, the CPU (an informing portion) 301 displays an indication of the error on the operation screen 400*a* of the operation panel 400, thereby informing the error to the operator. FIG. 8 is a view of an example of the screen for informing the error. Note that a message indicating the error may be a message indicating contents of the error, such as "DAMAGE OF FIXING FILM HAS OCCURRED," as well as an indication of guidance of operation to be performed by the operator, such as "PLEASE CONTACT SERVICEMAN." The method for informing the error is not limited to displaying of the indication, and may be informing methods using sound or blinking of a lamp. Alternatively, the CPU 301 may be configured to inform the operator of the error by displaying the error on a monitor (not shown) of the external PC connected to the image formation device 500 through the I/F portion 304.

When the operator having recognized the error displayed at S108 switches the power source switch 300 of the image formation device 500 to the OFF state (S109), the CPU 301 determines whether or not the fixing device 40 is in the pressed state (S110). When the fixing device 40 is not in the pressed state, the CPU 301 controls the pressing mechanism 119 to bring the fixing device 40 into the pressed state (S111).

Then, the CPU 301 stops a power supply to the image formation device 500 (i.e., powers OFF the image formation device 500) with the pressed state being maintained by the pressing pad 103 and the pressing roller 106 (S112). Note that after having stopped at S107, rotation of the pressing roller 106 and image formation by the image formation portion 7 are kept stopped until power-off.

When the CPU 301 detects occurrence of the crack of the fixing film 101 during continuous printing, urgent stop is sometimes made in a state in which the recording medium S in the middle of passing through the fixing device 40 is in the nip portion N of the fixing device 40. Thus, when the crack of the fixing film 101 has occurred and the recording medium S remains at the nip portion N, the fixing device 40 is brought into the pressed state. In the present embodiment, when detecting the crack of the fixing film 101, the CPU 301 powers OFF, as in S107 to S112, the image formation device 500 with the fixing device 40 remaining in the pressed state. In the configuration of the present embodiment, when the recording medium S is present at the nip portion N of the fixing device 40 in the pressed state, a total pressure of 196 N in a thickness direction of the recording medium S is applied from the fixing device 40 to the recording medium S. Thus, the total pressure of 196 N is kept applied to the recording medium S present at the nip portion N, leading to a state in which the operator cannot easily pull the recording medium S out of the nip portion N.

Note that in the present embodiment, it is configured such that regardless of whether or not the recording medium S remains at the nip portion N, the fixing device 40 is brought into the pressed state every time the crack of the fixing film 101 is detected. However, it may be configured such that the fixing device 40 is brought into the pressed state in a case where the recording medium S remains at the nip portion N in response to urgent stop due to occurrence of the crack of the fixing film 101, and is brought into the pressure release state in a case where the recording medium S does not remain at the nip portion N. For example, the CPU 301 can detect, based on the detection results of the conveyance sensors 405, whether or not the recording medium S remains at the nip portion N in the fixing device 40.

Subsequently, e.g., after the fixing device 40 has been removed from the attachment portion 502 of the image formation device 500 by a serviceman, the component including the cracked fixing film 101 or the entirety of the fixing device 40 is replaced with a new component.

Note that in a case where jam has occurred during normal printing, the CPU 301 interrupts image formation, and requests the operator to perform the jam processing for the recording medium S remaining on the conveyance path of the image formation device 500. Occurrence of jam during normal printing as described herein means that jam occurs with the CPU 301 not detecting the error due to the crack of the fixing film 101. In the case where jam has occurred at the fixing device 40 during normal printing, the CPU 301 brings the fixing device 40 into the pressure release state for easily performing the jam processing for the recording medium S remaining at the nip portion N.

[Definitions of Pressure Release State and Pressed State]

The definitions of the pressure release state and the pressed state in the present embodiment will be described herein.

The pressure release state indicates a state in which the recording medium S remaining at the nip portion N is pulled and moved by a tensile force of 9.8 N.

Note that an acceleration of gravity is 9.8 ($m/s^2$).

In the case where jam has occurred at the fixing device 40 during normal printing, the CPU 301 brings the fixing device 40 into the pressure release state for easily performing the jam processing for the recording medium S remaining at the nip portion N.

In the pressure release state, force required for pulling the recording medium S is set to equal to or lower than 9.8 N, assuming force easily output from a user with relatively-strong muscle strength among users assumed as the operator of the image formation device 500. For more easily performing the jam processing by a user with weaker muscle strength, the force required for pulling the recording medium S in the jam processing is preferably set to smaller force, and in the present embodiment, 3.0 N as an example.

Note that in the method for measuring the force required for pulling the recording medium S in the jam processing, the following <Conditions A> are applied to the fixing device 40 in the pressure release state, and a force gauge is pulled in a direction along the conveyance direction of the recording medium S at the nip portion N. Then, a value indicated by the force gauge when the recording medium S starts moving may be read.

That is, as a result of measurement of the force required for pulling the recording medium S out of the fixing device 40 in the jam processing under the following <Conditions A>, when the value indicated by the force gauge at (6) of <Conditions A> is equal to or less than 9.8 N, such a value means as follows. That is, this means a movable state (the pressure release state) when the recording medium S remaining at the nip portion N is pulled with a force of 9.8 N in the jam processing.

<Conditions A>: (1) to (6) are as follows.

(1) CS680 (with an A4 size) manufactured by Canon Inc. is used as the recording medium S.

(2) The direction of the recording medium S is set such that the direction of a short side of the recording medium S is coincident with the conveyance direction of the recording medium S.

(3) The length of the nip portion N in the conveyance direction of the recording medium S is referred to as a "nip width," providing that the recording medium S remains, across the entire nip width, at the nip portion N of the fixing device 40 in the pressure release state (i.e., a leading end or a trailing end of the recording medium S is not in the middle of the nip portion N).

(4) A hole is formed such that a distance from the leading end (an end positioned downstream of the nip portion N in the conveyance direction) of the recording medium S is 10 mm and a diameter about a center point in the width direction of the recording medium S is 5 mm.

(5) A hook attached to a leading end of the force gauge and having a diameter of 4 mm is hooked on the hole.

(6) In the state of (5), the force gauge is pulled in the direction along the conveyance direction of the recording medium S at the nip portion N. The value indicated by the force gauge when the recording medium S starts moving is the force required for pulling the recording medium S in the jam processing.

Note that the conditions of (4) and (5) are simulation of a situation where the jam processing is performed in a state in which the center of the recording medium S nipped at the nip portion N is pinched with two fingers of the operator.

On the other hand, the pressed state in the present embodiment is as follows.

As described above, in the present embodiment, when the CPU 301 detects the crack of the fixing film 101, the CPU 301 powers OFF the image formation device 500 with the fixing device 40 remaining in the pressed state, leading to the state in which the operator cannot easily pull the recording medium S out of the fixing device 40.

In the present embodiment, the state in which the operator cannot easily pull the recording medium S remaining at the nip portion N indicates a state in which the recording medium S remaining at the nip portion N does not move even when pulled with a tensile force of 9.8 N. That is, when the recording medium S does not move as a result of a test under the following <Conditions B>, the fixing device 40 is in the pressed state defined in the present embodiment.

<Conditions B>: (1) to (7) are as follows.

(1) CS680 (with the A4 size) manufactured by Canon Inc. is used as the recording medium S.

(2) The direction of the recording medium S is set such that the direction of the short side of the recording medium S is coincident with the conveyance direction of the recording medium S.

(3) The length of the nip portion N in the conveyance direction of the recording medium S is referred to as the "nip width," providing that the recording medium S is, across the entire nip width of the nip portion N, nipped at the fixing device 40 in the pressed state (i.e., the leading end or the trailing end of the recording medium S is not in the middle of the nip portion N).

(4) The hole is formed such that the distance from the leading end (the end positioned downstream of the nip portion N in the conveyance direction) of the recording medium S is 10 mm and the diameter about the center point in the width direction of the recording medium S is 5 mm.

(5) The hook attached to the leading end of the force gauge and having a diameter of 4 mm is hooked on the hole.

(6) In the state of (5), the force gauge is pulled such that the value indicated by the force gauge reaches 9.8 N. The pulling direction is the direction along the conveyance direction of the recording medium S at the nip portion N.

(7) When the recording medium S in the nip portion N does not start moving by (6), the fixing device 40 is in the pressed state defined in the present embodiment. Note that the pressed state defined in the present embodiment also includes a state in which a portion of the recording medium S in the nip portion N does not start moving by (6) and the force gauge can be no longer pulled due to the ripped recording medium S. On the other hand, when the recording medium S in the nip portion N starts moving by (6) or the recording medium S starts moving (i.e., with weaker force than 9.8 N) before the value indicated by the force gauge reaches 9.8 N in (6), the fixing device 40 is not in the pressed state defined in the present embodiment.

Note that the conditions of (4) and (5) are simulation of the situation where the jam processing is performed in the state in which the center of the recording medium S nipped at the nip portion N is pinched with the two fingers of the operator.

The pressed state shown in S107 to S112 may be a state in which the recording medium S does not move from the nip portion N of the fixing device 40 with a tensile force of 9.8 N upon the test under <Conditions B> described above.

In the pressed state shown in S107 to S112, the force required for pulling the recording medium S nipped at the nip portion N is greater than that in normal jam processing (jam processing in a case where no error due to the crack of the fixing film 101 occurs). Thus, in the pressed state shown in S107 to S112, it is more difficult for the operator to pull the recording medium S out of the fixing device 40 as compared to the normal jam processing.

Note that for much more difficult pulling of the recording medium S out of the fixing device 40, the following configuration is more preferably employed in the pressed state in response to the error due to the crack of the fixing film 101. That is, a state is much more preferable, in which the recording medium S does not move from the nip portion N of the fixing device 40 even with a tensile force of 49.0 N which is five times greater than the force easily output from the user with the relatively-strong muscle strength.

In the present embodiment, the pressed state shown in S107 to S112 is, as an example, the same state as that upon fixing, and is a state in which the recording medium S does not move from the nip portion N of the fixing device 40 with a tensile force of 50.0 N.

Typically, an image formation device stops operation thereof in response to detection of occurrence of a crack at a fixing film 101, and continuous image formation by means of the cracked fixing film 101 is inhibited. Thus, safety of the device in association with occurrence of the crack of the fixing film 101 is sufficiently ensured, and there is no problem on a typical product.

The configuration of the present embodiment aims safety rated one notch above as compared to the sufficient safety of the typical product, thereby further enhancing reliability of the safety of the device. That is, the probability of further expanding the crack of the fixing film 101 in a case where the user attempts to pull the recording medium S remaining at the nip portion N after the device has been stopped in response to detection of the crack of the film is reduced.

Specifically, in the configuration of the present embodiment, the image formation device 500 stops operation thereof in response to detection of the crack of the fixing film 101, and then, is powered OFF with the fixing device 40 remaining in the pressed state. Thus, it is difficult for the user to perform the process of pulling the recording medium S from the fixing device 40 while waiting for part replacement by the serviceman etc. after power-off, for example. For this reason, even if the user pulls, after stop of the device, the recording medium S remaining at the nip portion N, the fixing film 101 is less rotatable together with the recording medium S, and therefore, the probability of further expanding the crack can be reduced. This prevents the fixing film 101 from coming out of the fixing device 40 while the crack is being expanded. Thus, the safety of the device after the device has been stopped in response to detection of the crack of the fixing film 101 can be further enhanced.

Moreover, in the present embodiment, the CPU 301 maintains, without bringing the fixing device 40 into the pressure release state, the fixing device 40 in the pressed state when operation of the image formation device 500 is stopped (S107). Thus, even if the user pulls the recording medium S remaining at the nip portion N until the power source switch 300 is switched to the OFF state after urgent stop of the device, the fixing film 101 is less rotatable together with the recording medium S, and therefore, the probability of further expanding the crack can be reduced. That is, the safety of the device can be further enhanced.

Note that in the present embodiment, it is configured such that when the power source switch 300 is switched to the OFF state (S109), the CPU 301 determines, at S110, whether or not the fixing device 40 is in the pressed state, but the following configuration may be employed. That is, the fixing device 40 is in the pressed state during sheet passing. Thus, when stopping operation of the image formation device 500 (S107), the CPU 301 does not clear the pressed state of the fixing device 40. Then, the CPU 301 causes the pressing mechanism 119 to maintain the pressed state until the power source switch 300 is switched to the OFF state. With such a configuration, the CPU 301 can power OFF the image formation device 500 without the pressed state being checked at S110 and with the fixing device 40 being maintained in the pressed state. Thus, advantageous effects similar to those of the present embodiment can be provided.

Note that in the present embodiment, a single type of pressed state of the pressing mechanism 119 upon fixing has been described, but it may be configured to provide the pressing mechanism 119 which can be in multiple pressed states. For example, the pressure on the nip portion N is changed according to the type of recording medium S targeted for the fixing processing. In this case, when the power source switch 300 is switched to the OFF state in response to the error due to the crack of the fixing film 101, the CPU 301 controls the pressing mechanism 119 as follows. That is, the CPU 301 brings one of the multiple available pressed states of the pressing mechanism 119 satisfying the definition of the pressed state as described in [Definitions of Pressure Release State and Pressed State]. In description of S107 to S112, the CPU 301 may bring one of the multiple available pressed states of the pressing mechanism 119 satisfying the definition of the pressed state as described in [Definitions of Pressure Release State and Pressed State].

Second Embodiment

In the first embodiment, in the case of detecting the crack of the fixing film 101, it is, in response to switching of the power source switch 300 to the OFF state, determined whether or not the fixing device 40 is in the pressed state, and power is turned OFF with the pressed state being maintained.

In the present embodiment, a configuration will be described, in which in the case of detecting a crack of a fixing film 101, a fixing device 40 is brought into a pressed state prior to switching of a power source switch 300 to an OFF state.

Figure 11:
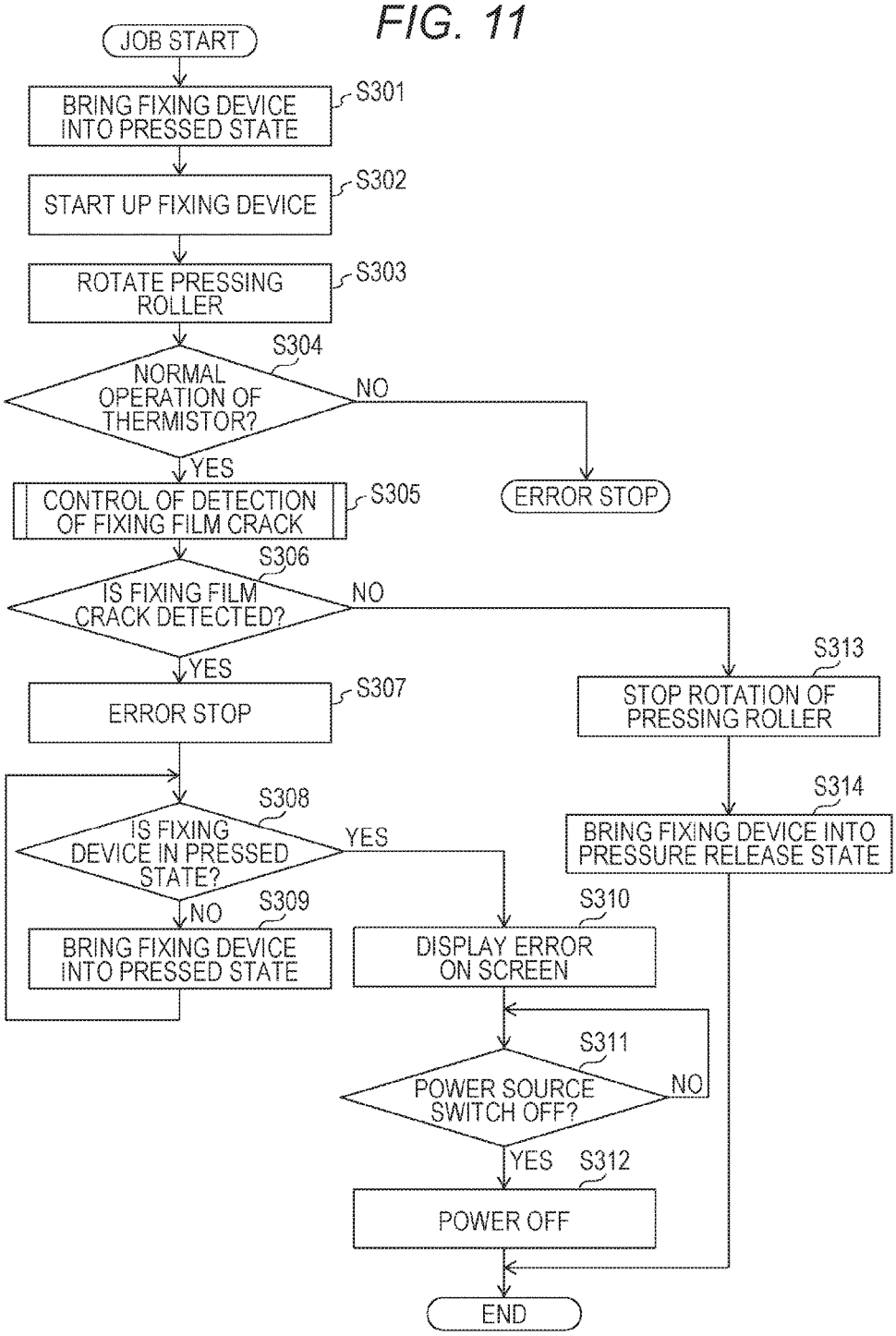
FIG. 11 is another example of the flowchart regarding the error due to the fixing film crack.

Note that in the present embodiment, a CPU 301 performs control according to a flowchart shown in FIG. 11 instead of the flowchart of FIG. 1 of the first embodiment. Other points are similar to those of the first embodiment, and therefore, detailed description thereof will not be repeated.

[Flowchart Regarding Error Due to Fixing Film Crack]

FIG. 11 is the flowchart regarding an error due to the fixing film crack.

An image formation device 500 of the present embodiment urgently stops image formation operation performed by the image formation device 500 in the case of detecting occurrence of the crack of the fixing film 101 during sheet passing. In this state, the relative positions of a pressing pad 103 and a pressing roller 106 in the fixing device 40 are maintained in the pressed state such that a recording medium remaining at a nip portion N of the fixing device 40 in response to stop of the device is not easily pulled out of the fixing device 40.

S301 to S305 are, in this order, similar to S101 to S105 (FIG. 1) of the first embodiment, and therefore, description thereof will not be repeated. Note that control at S305 is the same as that of the flowchart shown in FIG. 7 in the first embodiment.

When no crack of the fixing film 101 is detected (a flag indicating detection of the crack of the fixing film 101 is not set) (No at S306), the CPU 301 proceeds to S313. The CPU 301 turns OFF energization of a heater 100, and stops rotation of the pressing roller 106 (S313). Then, a pressing mechanism 119 is controlled such that the fixing device 40 is brought into a pressure release state (S314). In the present embodiment, the case of not detecting the crack of the fixing film 101 through the flowchart of FIG. 7 is the case of terminating a job without detection of the crack of the fixing film 101. Thus, great pressure is not applied to the nip portion N. This can suppress a pressing mark from remaining at the fixing film 101 in the case of a long standby time until subsequent job input (including the case of power-off after use of the device has been normally terminated).

On the other hand, in the case of detecting the crack of the fixing film 101 (the case of setting the flag indicating detection of the crack of the fixing film 101) (Yes at S306), the CPU 301 promptly stops operation of the image formation device 500 (S307). Specifically, the CPU 301 stops rotation of the pressing roller 106, and turns OFF energization of the heater 100. Moreover, the CPU 301 stops image formation performed by the image formation portion 7, as well as stopping conveyance of the recording medium S by the feeding device 13. That is, the image formation device 500 does not continue image formation with the crack remaining at the fixing film 101, and therefore, safety of the image formation device 500 can be sufficiently ensured. Note that for realizing safety rated one notch above, the CPU 301 preferably maintains the pressed state without bringing the fixing device 40 into the pressure release state.

Then, the CPU 301 determines, in addition to error stop at S307, whether or not the fixing device 40 is in the pressed state (S308). When the fixing device 40 is not in the pressed state, the CPU 301 controls the pressing mechanism 119 to bring the fixing device 40 into the pressed state (S309).

After having brought the fixing device 40 into the pressed state, the CPU 301 displays, at S310, an indication of the error on an operation screen 400*a* of an operation panel 400, thereby informing the error to an operator. Details of informing of the error are similar to those of S108 (FIG. 1) of the first embodiment, and therefore, description thereof will not be repeated.

When the operator having recognized the error displayed at S310 switches the power source switch 300 of the image formation device 500 to an OFF state (S311), the CPU 301 powers OFF the image formation device 500 (S312). In this state, the CPU 301 checks the pressed state of the fixing device 40 at S308, and then, continuously maintains the pressed state of the fixing device 40 until power-off. Thus, even in the case of removing the fixing device 40 out of an attachment portion 502 of the image formation device 500 before the operator switches the power source switch 300 to the OFF state, the pressed state is continued until the fixing device 40 is removed. Moreover, even in the case of power-off before removal of the fixing device 40 from the attachment portion 502 and after stop of the device in response to the crack of the fixing film 101, the pressed state is also maintained. Note that after having stopped at S307, rotation of the pressing roller 106 and image formation performed by the image formation portion 7 are kept stopped until power-off.

When the CPU 301 detects occurrence of the crack of the fixing film 101 during continuous printing, urgent stop is sometimes made in a state in which the recording medium S in the middle of passing through the fixing device 40 is in the nip portion N of the fixing device 40. Thus, when the crack of the fixing film 101 occurs and the recording medium S remains at the nip portion N, the fixing device 40 is brought into the pressed state. In the present embodiment, when detecting the crack of the fixing film 101, the CPU 301 maintains, as in S307 to S312, the fixing device 40 in the pressed state. In the configuration of the present embodiment, when the recording medium S is present at the nip portion N of the fixing device 40 in the pressed state, a total pressure of 196 N in a thickness direction of the recording medium S is applied from the fixing device 40 to the recording medium S. Thus, the total pressure of 196 N is kept applied to the recording medium S present at the nip portion N, leading to a state in which it is difficult for the operator to perform the process of pulling the recording medium S out of the fixing device 40.

Note that in the present embodiment, it is configured such that regardless of whether or not the recording medium S remains at the nip portion N, the fixing device 40 is brought into the pressed state every time the crack of the fixing film 101 is detected. However, it may be configured such that the fixing device 40 is brought into the pressed state in a case where the recording medium S remains at the nip portion N in response to urgent stop due to occurrence of the crack of the fixing film 101, and is brought into the pressure release state in a case where the recording medium S does not remain at the nip portion N. For example, the CPU 301 can detect, based on detection results of conveyance sensors 405, whether or not the recording medium S remains at the nip portion N in the fixing device 40.

Subsequently, e.g., after the fixing device 40 has been removed from the attachment portion 502 of the image formation device 500 by a serviceman, the component including the cracked fixing film 101 or the entirety of the fixing device 40 is replaced with a new component.

Note that in a case where jam has occurred at the fixing device 40 during normal printing, the CPU 301 brings the fixing device 40 into the pressure release state so that jam processing can be easily performed for the recording medium S remaining at the nip portion N. Occurrence of jam during normal printing as described herein means that jam occurs with the CPU 301 not detecting the error due to the crack of the fixing film 101.

Typically, an image formation device stops operation thereof in response to detection of occurrence of a crack at a fixing film 101, and continuous image formation by means of the cracked fixing film 101 is inhibited. Thus, safety of the device in association with occurrence of the crack of the fixing film 101 is sufficiently ensured, and there is no problem on a typical product.

The configuration of the present embodiment aims safety rated one notch above as compared to the sufficient safety of the typical product, thereby further enhancing reliability of the safety of the device. Specifically, after error stop of the image formation device 500, the fixing device 40 is maintained in the pressed state. Thus, even if a user pulls the recording medium S remaining at the nip portion N, the fixing film 101 is less rotatable together with the recording medium S, and therefore, the probability of further expanding the crack can be reduced. This prevents the fixing film 101 from coming out of the fixing device 40 together with the recording medium S while the crack is being expanded. Moreover, the image formation device 500 is powered OFF with the fixing device 40 being in the pressed state. Thus, even if the user pulls, after power-off, the recording medium S remaining at the nip portion N, the fixing film 101 is less rotatable together with the recording medium S, and therefore, the probability of further expanding the crack can be reduced. This prevents the fixing film 101 from coming out of the fixing device 40 together with the recording medium S while the crack is being expanded.

Thus, the safety of the device after stop of the device in response to detection of the crack of the fixing film 101 can be further enhanced.

Note that in the present embodiment, the CPU 301 is configured to stop operation of the image formation device 500 in response to detection of the crack of the fixing film 101 (S307) and to determine whether or not the fixing device 40 is in the pressed state (S308). However, the following configuration may be employed. That is, since the fixing device 40 is in the pressed state during sheet passing, the CPU 301 does not clear the pressed state of the fixing device 40 when operation of the image formation device 500 is stopped (S307). Then, the CPU 301 causes the pressing mechanism 119 to maintain the pressed state until the power source switch 300 is switched to the OFF state. With this configuration, the CPU 301 can maintain the fixing device 40 in the pressed state without checking the pressed state at S308, and therefore, advantageous effects similar to those of the present embodiment can be provided.

Note that in the present embodiment, a single type of pressed state of the pressing mechanism 119 upon fixing has been described, but it may be configured to provide the pressing mechanism 119 which can be in multiple pressed states. For example, pressure on the nip portion N is changed according to the type of recording medium S targeted for the fixing processing. In this case, when the error due to the crack of the fixing film 101 occurs, the CPU 301 brings one of the multiple available pressed states of the pressing mechanism 119 satisfying the definition of the pressed state as described in [Definitions of Pressure Release State and Pressed State]. That is, in description of S307 to S312, the CPU 301 may bring one of the multiple available pressed states of the pressing mechanism 119 satisfying the definition of the pressed state as described in [Definitions of Pressure Release State and Pressed State].

Third Embodiment

In the first and second embodiments, the case where the pressed state is common between the time of execution of the fixing processing and the time of detection of the crack of the fixing film 101 has been described as an example.

Specifically, in the first embodiment, it is configured to bring the pressed state common between both of the time of execution of the fixing processing and the time of switching of the power source switch 300 to the OFF state in response to the error due to the crack of the fixing film 101 (S107 to S112). Moreover, in the second embodiment, it is configured to bring the pressed state common between both of the time of execution of the fixing processing and the time of occurrence of the error due to the crack of the fixing film 101 (S307 to S311).

However, the present disclosure is not limited to above as long as the pressed state upon occurrence of the error due to the crack of the fixing film 101 (and/or upon switching of the power source switch 300 to the OFF state in response to such an error) satisfies the definition of the pressed state as described in [Definitions of Pressure Release State and Pressed State]. That is, it may be configured such that the pressed state upon execution of the fixing processing and the pressed state upon occurrence of the error due to the crack of the fixing film 101 (and/or upon switching of the power source switch 300 to the OFF state in response to such an error) are different from each other.

In the present embodiment, a case where the configuration of employing the pressed states different from each other between the time of fixing and the time of occurrence of the error is applied to the control of the first embodiment will be described as an example. Note that other configurations are similar to those of the first embodiment, and therefore, description thereof will not be repeated.

For the sake of description, the pressed state upon execution of the fixing processing will be, in the present embodiment, referred to as a "pressed state X," and the pressed state upon switching of the power source switch 300 to the OFF state in response to the error will be referred to as a "pressed state Y."

The pressed state X is a state in which sufficient pressure for fixing toner onto the recording medium S is applied to the nip portion N. For example, in the present embodiment, a total pressure of 196 N is applied to the nip portion N. At S101 in FIG. 1, the CPU 301 sends a signal with a predetermined pulse number to the motor of the pressing mechanism 119 to drive the motor, thereby rotating the cam 114 to a predetermined position. In this manner, the CPU 301 brings the fixing device 40 into the pressed state X. Note that it may be configured as follows: for accurate control, a sensor configured to detect the position of the cam 114 is provided and the motor is driven until the sensor detects that the cam 114 reaches the predetermined position.

On the other hand, the pressed state Y may be a state satisfying the definition of the pressed state as described in [Definitions of Pressure Release State and Pressed State]. Thus, the CPU 301 may be configured to send more (or less) signals than those of the pressed state X by several pulses at S111, thereby determining the position of the cam 114. A distance between a circumferential surface of the cam 114 and the shaft 115 is not uniform. Thus, the position of the cam 114 in the pressed state Y is slightly shifted from that in the pressed state X, and therefore, the pressed state Y in which pressure on the fixing flange 104 from the pressing plate 113 is different from that in the pressed state X can be brought. The several pulses at S111 as described herein are such a preset value that the pressed state Y is the state satisfying the definition of the pressed state as described in [Definitions of Pressure Release State and Pressed State]. The configuration of the present embodiment is understood in such a manner that the pressed state at S107 to S112 is replaced with the pressed state Y in description of the flowchart of FIG. 1 in the first embodiment.

Note that in the present embodiment, the case where the configuration of employing the pressed states different from each other between the time of fixing and the time of occurrence of the error is applied to the control of the first embodiment has been described as an example, but such a configuration may be applied to the control of the second embodiment. In this case, the configuration is understood in such a manner that the pressed state at S307 to S312 is replaced with the above-described pressed state Y in description of the flowchart of FIG. 11 in the second embodiment.

Fourth Embodiment

In the first to third embodiments, the method is employed, in which occurrence of the crack of the fixing film 101 is detected based on the temperatures of both end portions of the fixing film 101 detected by the thermistor 105F and the thermistor 105R. However, in the first to third embodiments, the method for detecting occurrence of the crack of the fixing film 101 may be as follows.

For example, control may be made based on the time rate of change in a temperature difference between the thermistor 105F (or the thermistor 105R) and the thermistor 105C in the center area of the fixing film 101 in the longitudinal direction thereof. It is preferably configured such that for detecting the crack at each end portion of the fixing film 101, both of the time rate of change in the temperature difference between the thermistor 105F and the thermistor 105C and the time rate of change in a temperature difference between the thermistor 105R and the thermistor 105C are measured. When the time rate of change in any of the temperature differences exceeds the predetermined value, the CPU 301 determines that the crack of the fixing film 101 has occurred.

Note that for the thermistor 105C in the center area, a change in the temperature of the fixing film 101 due to sheet passing more influences the time rate of change in the temperature difference as compared to the thermistors 105F, 105R in the end areas. Thus, the detection method used in the first to third embodiments is more preferable.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-244799, filed Dec. 16, 2016, which is hereby incorporated by reference herein in its entirety.

What is claimed is:

1. An image forming device comprising:

an image forming portion configured to form an image on a recording medium;

an endless belt including a layer containing metal, the endless belt configured to heat, at a nip portion, the image formed on the recording medium by the image forming portion;

a nip formation member provided on an inside of the endless belt;

a rotary member cooperating with the endless belt to form the nip portion and configured to rotate the endless belt;

a pressing mechanism configured to press the nip formation member and the rotary member to form the nip portion, the pressing mechanism causing a relative position of the nip formation member to the rotary member to be at a first position at which a predetermined recording medium remaining between the endless belt and the rotary member is pullable with a tensile force of 9.8 N or a second position at which the predetermined recording medium remaining between the endless belt and the rotary member is not pullable with the tensile force of 9.8 N;

a detecting portion configured to detect a crack of an end portion of the endless belt;

a rotation control portion configured to stop rotation of the rotary member according to detection of the crack of the end portion of the endless belt by the detecting portion;

an informing portion configured to inform an error in response to detection of the crack of the end portion of the endless belt by the detecting portion;

a power source switch switchable between an OFF state for stopping a power supply to the image forming device and an ON state for supplying power to the image forming device; and a pressing control portion configured to control the pressing mechanism, wherein when jam causing the recording medium to remain at the nip portion occurs without detection of the crack of the end portion of the endless belt by the detecting portion, the pressing control portion controls the pressing mechanism such that the relative position is at the first position, and when the error is informed by the informing portion and the jam causing the recording medium to remain at the nip portion occurs and the power source switch is switched to the OFF state, the pressing control portion controls the pressing mechanism such that the power supply to the image forming device is stopped with the relative position being at the second position.

2. The image forming device according to claim 1, wherein when the jam causing the recording medium to remain at the nip portion occurs without detection of the crack of the end portion of the endless belt by the detecting portion, the pressing control portion controls the pressing mechanism such that the relative position is at the first position, and when the detecting portion detects the crack of the end portion of the endless belt and the jam causing the recording medium to remain at the nip portion occurs, the pressing control portion maintains the relative position at the second position.

3. The image forming device according to claim 1, wherein when the endless belt is removed from the image forming device before the power source switch is first switched to the OFF state since the informing portion has informed the error, the rotation control portion keeps stopping the rotation of the rotary member, and the pressing control portion maintains the relative position at the second position until the endless belt is removed from the image forming device after the informing portion has informed the error.

4. The image forming device according to claim 1, further comprising:

a first sensor configured to detect a temperature of the endless belt in a first end area, the first end area being, in a longitudinal direction of the endless belt, on an outside of an area where a recording medium with a minimum width as a size in a width direction among recording media heatable at the nip portion passes; and a second sensor configured to detect the temperature of the endless belt in a second end area, the second end area being, in the longitudinal direction of the endless belt, on the outside of the area and on an opposite side of the first end area, wherein the detecting portion detects the crack of the end portion of the endless belt based on a difference between a detection temperature of the first sensor and a detection temperature of the second sensor.

5. The image forming device according to claim 4, wherein according to a state in which an amount of change in the difference between the detection temperature of the first sensor and the detection temperature of the second sensor per unit time exceeds a predetermined value, the detecting portion determines that the crack of the end portion of the endless belt has occurred.

6. The image forming device according to claim 1, wherein when the image formed by the image forming portion is heated while the recording medium is being conveyed at the nip portion, the pressing control portion controls the pressing mechanism such that the relative position is at the second position.

7. An image forming device, comprising:

an image forming portion configured to form an image on a recording medium;

an endless belt including a layer containing metal, the endless belt being configured to heat, at a nip portion, the image formed on the recording medium by the image forming portion;

a nip formation member provided on an inside of the endless belt;

a rotary member cooperating with the endless belt to form the nip portion and configured to rotate the endless belt;

a pressing mechanism configured to press the nip formation member and the rotary member to form the nip portion, the pressing mechanism causing a relative position of the nip formation member to the rotary member to be at a first position at which a predetermined recording medium remaining between the endless belt and the rotary member is pullable with a tensile force of 9.8 N, a second position at which the predetermined recording medium remaining between the endless belt and the rotary member is not pullable with the tensile force of 9.8 N, or a third position at which the image formed on the recording medium by the image forming portion is heated;

a detecting portion configured to detect a crack of an end portion of the endless belt;

a rotation control portion configured to stop rotation of the rotary member according to detection of the crack of the end portion of the endless belt by the detecting portion;

an informing portion configured to inform an error in response to detection of the crack of the end portion of the endless belt by the detecting portion;

a power source switch switchable between an OFF state for stopping a power supply to the image forming device and an ON state for supplying power to the image forming device; and a pressing control portion configured to control the pressing mechanism, wherein when jam causing the recording medium to remain at the nip portion occurs without detection of the crack of the end portion of the endless belt by the detecting portion, the pressing control portion controls the pressing mechanism such that the relative position is at the first position, and when the error is informed by the informing portion and the jam causing the recording medium to remain at the nip portion occurs, and the power source switch is switched to the OFF state, the pressing control portion controls the pressing mechanism such that the power supply to the image forming device is stopped with the relative position being at the second position.

8. The image forming device according to claim 7, wherein when the jam causing the recording medium to remain at the nip portion occurs without detection of the crack of the end portion of the endless belt by the detecting portion, the pressing control portion controls the pressing mechanism such that the relative position is at the first position, and when the detecting portion detects the crack of the end portion of the endless belt and the jam causing the recording medium to remain at the nip portion occurs, the pressing control portion controls the pressing mechanism such that the relative position is at the second position.

9. The image forming device according to claim 7, wherein when the endless belt is removed from the image forming device before the power source switch is first switched to the OFF state since the informing portion has informed the error, the rotation control portion keeps stopping the rotation of the rotary member, and the pressing control portion maintains the relative position at the second position until the endless belt is removed from the image forming device after the informing portion has informed the error.

10. The image forming device according to claim 7, further comprising:

a first sensor configured to detect a temperature of the endless belt in a first end area, the first end area being, in a longitudinal direction of the endless belt, on an outside of an area where a recording medium with a minimum width as a size in a width direction among recording media heatable at the nip portion passes; and a second sensor configured to detect the temperature of the endless belt in a second end area, the second end area being, in the longitudinal direction of the endless belt, on the outside of the area and on an opposite side of the first end area, wherein the detecting portion detects the crack of the end portion of the endless belt based on a difference between a detection temperature of the first sensor and a detection temperature of the second sensor.

11. The image forming device according to claim 10, wherein according to a state in which an amount of change in the difference between the detection temperature of the first sensor and the detection temperature of the second sensor per unit time exceeds a predetermined value, the detecting portion determines that the crack of the end portion of the endless belt has occurred.

12. An image forming device comprising:

an image forming portion configured to form an image on a recording medium;

an endless belt including a layer containing metal, the endless belt being configured to heat, at a nip portion, the image formed on the recording medium by the image forming portion;

a nip formation member provided on an inside of the endless belt;

a rotary member cooperating with the endless belt to form the nip portion and configured to rotate the endless belt;

a pressing mechanism configured to press the nip formation member and the rotary member to form the nip portion, the pressing mechanism causing a relative position of the nip formation member to the rotary member to be at a first position or a second position different from the first position and the nip portion being formed at the second position;

a detecting portion configured to detect a crack of an end portion of the endless belt;

a rotation control portion configured to stop rotation of the rotary member according to detection of the crack of the end portion of the endless belt by the detecting portion;

an informing portion configured to inform an error in response to detection of the crack of the end portion of the endless belt by the detecting portion;

a power source switch switchable between an OFF state for stopping a power supply to the image forming device and an ON state for supplying power to the image forming device; and a pressing control portion configured to control the pressing mechanism, wherein when jam causing the recording medium to remain at the nip portion occurs without detection of the crack of the end portion of the endless belt by the detecting portion, the pressing control portion controls the pressing mechanism such that the relative position is at the first position, and when the error is informed by the informing portion and the jam causing the recording medium to remain at the nip portion occurs, if the power source switch is switched to the OFF state, the pressing control portion controls the pressing mechanism such that the power supply to the image forming device is stopped with the relative position being at the second position.

13. The image forming device according to claim 12, wherein the first position is a position at which pressure on the nip portion is smaller than that at the second position.

14. The image forming device according to claim 12, wherein the first position is a position at which pressing force does not act between the nip formation member and the rotary member.

15. The image forming device according to claim 12, wherein when the jam causing the recording medium to remain at the nip portion occurs without detection of the crack of the end portion of the endless belt by the detecting portion, the pressing control portion controls the pressing mechanism such that the relative position is at the first position, and when the detecting portion detects the crack of the end portion of the endless belt and the jam causing the recording medium to remain at the nip portion occurs, the pressing control portion maintains the relative position at the second position.

16. The image forming device according to claim 12, wherein when the image formed by the image forming portion is heated while the recording medium is being conveyed at the nip portion, the pressing control portion controls the pressing mechanism such that the relative position are at the second position.

17. An image forming device comprising:

an image forming portion configured to form an image on a recording medium;

an endless belt including a layer containing metal, the endless belt being configured to heat, at a nip portion, the image formed on the recording medium by the image forming portion;

a nip formation member provided on an inside of the endless belt;

a rotary member cooperating with the endless belt to form the nip portion and configured to rotate the endless belt;

a pressing mechanism configured to press the nip formation member and the rotary member to form the nip portion, the pressing mechanism causing a relative position of the nip formation member to the rotary member to be at a first position, a second position which is different from the first position and at which the nip portion is formed, or a third position which is different from the first position and the second position and at which the image formed on the recording medium by the image forming portion is heated;

a detecting portion configured to detect a crack of an end portion of the endless belt;

a rotation control portion configured to stop rotation of the rotary member according to detection of the crack of the end portion of the endless belt by the detecting portion;

an informing portion configured to inform an error in response to detection of the crack of the end portion of the endless belt by the detecting portion;

a power source switch switchable between an OFF state for stopping a power supply to the image forming device and an ON state for supplying power to the image forming device; and a pressing control portion configured to control the pressing mechanism, wherein when jam causing the recording medium to remain at the nip portion occurs without detection of the crack of the end portion of the endless belt by the detecting portion, the pressing control portion controls the pressing mechanism such that the relative position is at the first position, and when the error is informed by the informing portion and the jam causing the recording medium to remain at the nip portion occurs, and the power source switch is switched to the OFF state, the pressing control portion controls the pressing mechanism such that the power supply to the image forming device is stopped with the relative position being at the second position.

18. The image forming device according to claim 17, wherein when the jam causing the recording medium to remain at the nip portion occurs without detection of the crack of the end portion of the endless belt by the detecting portion, the pressing control portion controls the pressing mechanism such that the relative position is at the first position, and when the detecting portion detects the crack of the end portion of the endless belt and the jam causing the recording medium to remain at the nip portion occurs, the pressing control portion controls the pressing mechanism such that the relative position is at the second position.

19. The image forming device according to claim 17, wherein the first position is a position at which pressure on the nip portion is smaller than those at the second position and the third position.

20. The image forming device according to claim 17, wherein the first position is a position at which pressing force does not act between the nip formation member and the rotary member.

* * * * *